US006855057B2

(12) United States Patent
Namba et al.

(10) Patent No.: US 6,855,057 B2
(45) Date of Patent: Feb. 15, 2005

(54) NETWORK GAME SYSTEM, NETWORK GAME DEVICE, NETWORK GAME METHOD AND READABLE STORAGE MEDIUM STORING NETWORK GAME PROGRAM

(75) Inventors: Kazuhiro Namba, Amagasaki (JP); Masatoshi Yamaoka, Amagasaki (JP); Satoko Naito, Sakai (JP); Katsuhiro Goto, Neyagawa (JP); Hirotomo Yotsugi, Osaka (JP)

(73) Assignee: KCEO Inc., Osaka (JP)

( * ) Notice: Subject to any disclaimer, the term of this patent is extended or adjusted under 35 U.S.C. 154(b) by 0 days.

(21) Appl. No.: 09/820,559

(22) Filed: Mar. 29, 2001

(65) Prior Publication Data

US 2001/0027130 A1 Oct. 4, 2001

(30) Foreign Application Priority Data

Mar. 31, 2000 (JP) ..... 2000-098955

(51) Int. Cl.[7] ..... A63F 9/24

(52) U.S. Cl. ..... 463/42; 463/40

(58) Field of Search ..... 463/1, 7–9, 29–31, 463/36, 40–43; 705/1, 14

(56) References Cited

U.S. PATENT DOCUMENTS 4,712,799 A * 12/1987 Fraley ..... 210/532.2
4,951,039 A * 8/1990 Schwendeman ..... 340/725
5,048,831 A * 9/1991 Sides ..... 273/85

(List continued on next page.)

FOREIGN PATENT DOCUMENTS

| | | |
|---|---|---|
| DE | 19640860 | 4/1998 |
| EP | 0784258 | 7/1997 |
| EP | 0823272 | 2/1998 |
| EP | 0844010 | 5/1998 |
| GB | 2338091 | 12/1999 |
| JP | 9-140938 | 6/1997 |
| JP | 11-192384 | 7/1999 |
| JP | 11-290552 | 10/1999 |
| JP | 2000-42253 | 2/2000 |

(List continued on next page.)

OTHER PUBLICATIONS

'Pokemon Stadium', IGN.com, 1998, Nintendo/Creatures, Inc/Game Freak, Inc.*
'Ultima Online', UO.com, 1997, Electronic Arts, Inc.*
'Petz', PETZ.com, 1998, Mattel, Inc.*
Yoshida et al, 'Princess Maker—Legend of Another World—Raising A Daughter', 1995.*

*Primary Examiner*—Mark Sager
*Assistant Examiner*—Steven Ashburn
(74) *Attorney, Agent, or Firm*—Jordan and Hamburg LLP

(57) ABSTRACT

A network game having bi-directional characteristics by means of a network, wherein prescribed data corresponding to a game result is transmitted to a game-player and the game result is provided with general applicability and future development possibilities. The character training game system consists of a web (WWW) server 1 located on the Internet and a mobile telephone device 20. The server 1 comprises a character training-type game device 10. This game device 10 comprises internal hardware and software for a character training game, for example, at the least, a training processing section 100, and a transmission and reception control section 112 for controlling data reception and transmission processing with respect to the Internet. The network center 30 mediates the connection between the mobile telephone device 20 and the Internet. Game images from the game device 10 are displayed on the monitor of the mobile telephone device 20, and a game is developed by sending back response data by operating keys. A training result is transmitted from the server 1 to the mobile telephone device 20.

31 Claims, 20 Drawing Sheets

U.S. PATENT DOCUMENTS

| | | | | | |
|---|---|---|---|---|---|
| 5,073,931 | A | * | 12/1991 | Audebert et al. | 380/251 |
| 5,213,337 | A | * | 5/1993 | Sherman | 463/40 |
| 5,267,734 | A | * | 12/1993 | Stamper et al. | 273/434 |
| 5,428,528 | A | * | 6/1995 | Takenouchi et al. | 364/410 |
| 5,498,002 | A | * | 3/1996 | Gechter | 273/434 |
| 5,738,583 | A | * | 4/1998 | Comas et al. | 463/40 |
| 5,762,552 | A | | 6/1998 | Vuong et al. | |
| 5,855,516 | A | * | 1/1999 | Eiba | 463/42 |
| 5,890,963 | A | * | 4/1999 | Yen | 463/42 |
| 5,905,523 | A | * | 5/1999 | Woodfield et al. | 348/12 |
| 5,947,823 | A | * | 9/1999 | Nimura | 463/32 |
| 5,971,855 | A | * | 10/1999 | Ng | 463/42 |
| 6,007,426 | A | * | 12/1999 | Kelly et al. | 463/16 |
| 6,009,458 | A | * | 12/1999 | Hawkins et al. | 709/203 |
| 6,117,013 | A | * | 9/2000 | Eiba | 463/41 |
| 6,165,068 | A | * | 12/2000 | Sonada et al. | 463/8 |
| 6,174,236 | B1 | * | 1/2001 | Tsuda et al. | 463/41 |
| 6,174,237 | B1 | * | 1/2001 | Stephenson | 463/42 |
| 6,179,713 | B1 | * | 1/2001 | James et al. | 463/42 |
| 6,227,966 | B1 | * | 5/2001 | Yokoi | 463/1 |
| 6,293,865 | B1 | * | 9/2001 | Kelly et al. | 463/16 |
| 6,409,602 | B1 | * | 6/2002 | Wiltshire et al. | 463/16 |
| 2001/0044339 | A1 | * | 11/2001 | Cordero et al. | 463/42 |

FOREIGN PATENT DOCUMENTS

| | | |
|---|---|---|
| KR | 1999-86588 | 12/1999 |
| WO | 96/23289 | 8/1996 |
| WO | 99/26204 | 5/1999 |
| WO | 00/30729 | 6/2000 |
| WO | 00/66237 | 11/2000 |

* cited by examiner

NETWORK GAME SYSTEM, NETWORK GAME DEVICE, NETWORK GAME METHOD AND READABLE STORAGE MEDIUM STORING NETWORK GAME PROGRAM

BACKGROUND OF THE INVENTION

1. Field of the Invention

The present invention relates to network game technology implemented by means of a network.

2. Description of the Related Art

There are known conventional games wherein a single game space is constructed in the game device of two game-players connected by means of a network (Internet or e-mail network), in such a manner that the game-players can play a competitive game, or the like, in that game space, without feeling any sense of distance, in other words, in spite of being situated in mutually remote locations. Moreover, there also exist Internet sites capable of transmitting simple games, and so-called i mode games, wherein games can be played by accessing these game sites from mobile telephones.

In the first type of game, in practice, a game played between adjacent game-players is simply expanded to remote locations. Moreover, in the second type of game, although there is bi-directional communication between game-players and the site, the game result is not provided with any further applicability or use, and the game development always finishes at the end of a game.

SUMMARY OF THE INVENTION

The present invention was devised with the foregoing in mind, an object thereof being to provide a network game having bi-directional characteristics by means of a network, a network game system, network game device and network game method, wherein game results are transmitted to a game-player and the game results are provided with general applicability and future development possibilities, and a readable storage medium for storing a network game program.

The network game device relating to the present invention is a server side game device for performing game processing on the basis of received data, provided with transmitting and receiving means for transmitting and receiving game data, via a network, with respect to a terminal device provided with a monitor and an operating member; comprising means for creating prescribed data corresponding to game results, wherein the transmitting and receiving means transmits the created prescribed data to the terminal device, via the network.

Moreover, the present invention is also a network game method for a server side game device for performing game processing on the basis of received data, composed in such a manner that it transmits and receives game data, via a network, with respect to a terminal device provided with a monitor and an operating member; comprising the steps of: creating prescribed data corresponding to game results at the end of a game; and transmitting the created prescribed data to the terminal device, via the network.

Furthermore, the present invention is also a readable storage medium storing a network game program for controlling a server side game device for performing game processing on the basis of received data, composed in such a manner that it transmits and receives game data, via a network, with respect to a terminal device provided with a monitor and an operating member; whereby the game device performs the steps of: creating prescribed data corresponding to game results at the end of a game; and transmitting the created prescribed data to the terminal device, via the network.

According to these compositions, a network game is executed by the server side game device which performs transmission and reception of game data with respect to a terminal device comprising a monitor and operating member by means of accessing the terminal device via the network, and also performs game processing on the basis of received data sent from the terminal device. When the game ends, prescribed data corresponding to the game result is created and the prescribed data thus created is sent to the terminal device by means of the Internet or an electronic mail (e-mail) network, or the like.

Furthermore, the present invention is also a network game system constituted by a server side game device located on a network and performing game processing and transmission and reception of game data, and a terminal device comprising a monitor and operating member and being capable of transmitting and receiving game data with respect to the server side game device by means of the network, wherein the server side game device comprises: means for creating prescribed data corresponding to game results; and means for transmitting the created prescribed data to the terminal device, by means of the network; and the terminal device comprises: means for creating response data by operating the operating member in response to game data received from the server side game device, and transmitting the response data to the server side game device; and means for receiving the prescribed data.

According to this composition, the server side game device implements a game by exchanging game data with the terminal device, and when the game ends, it creates prescribed data corresponding to a game result and transmits the prescribed data thus created to the terminal device, via the network. The terminal device, on the other hand, creates response data by means of the operating member being operated, in response to the game data received from the server side game device, and transmits this response data to the server side game device, and it also receives the aforementioned prescribed data transmitted by the server side game device at the end of a game.

These and other objects, features and advantages of the present invention will become more apparent upon reading of the following detailed description along with the accompanied drawings.

DESCRIPTION OF THE PREFERRED EMBODIMENTS

Figure 1:
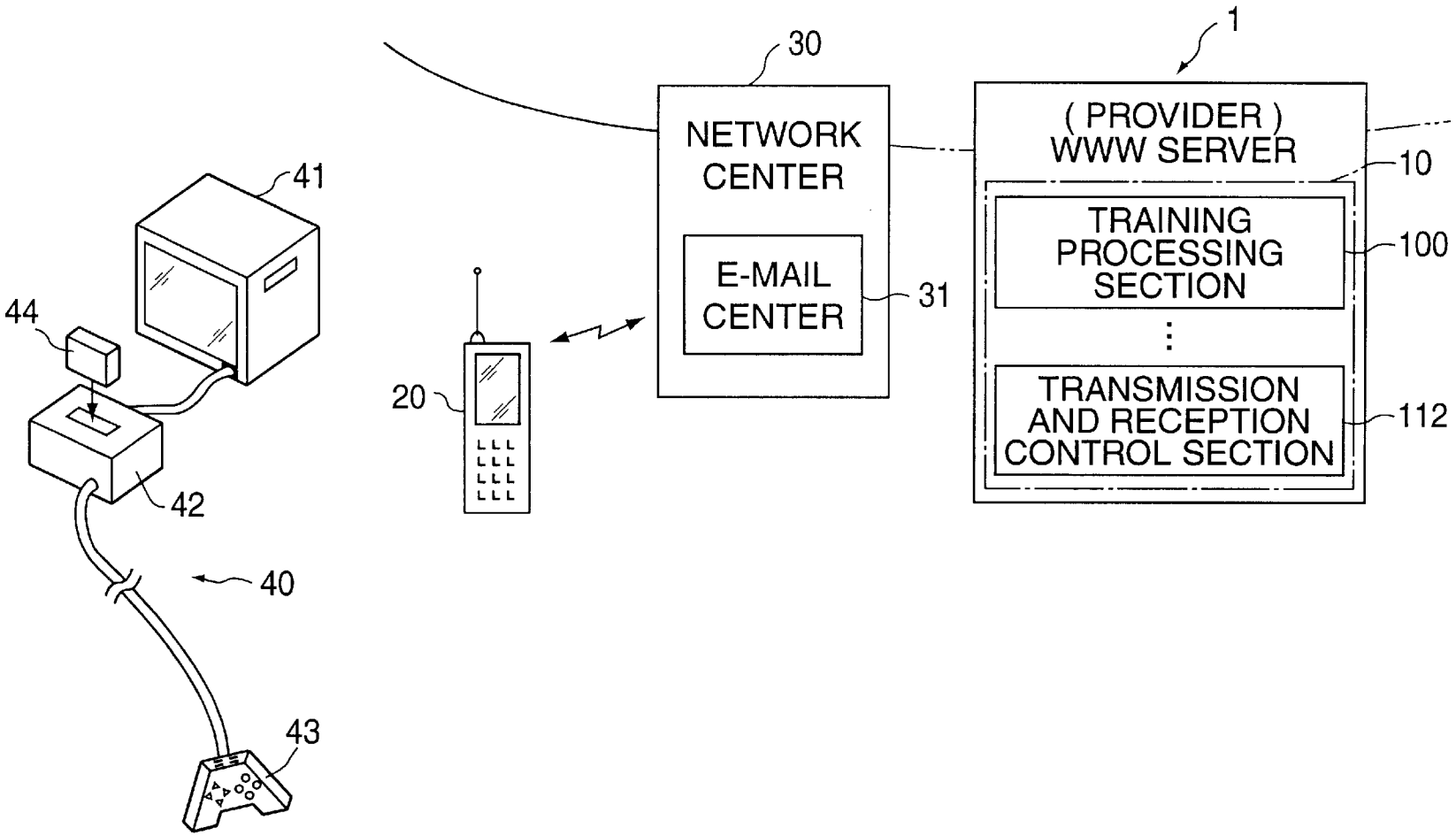
FIG. 1 is a diagram showing the overall composition of a character training game system to which the present invention is applied.

FIG. 1 is a diagram showing the overall composition of a case where the network game system relating to the present invention is applied to a character training-type game system. In FIG. 1, numeral 1 denotes a web (WWW) server located on the Internet, which forms a network, and 20 denotes a mobile communication device forming a terminal device, and in this example, is represented by a mobile telephone device.

The web server 1 is a server which is designated from a plurality of servers located on the Internet (for example, a provider contracted by the person running the present system, or the like), and it comprises a character training-type game device 10 forming a server-side game device. This character training-type game device 10 comprises internal hardware and software for character training type games. For example, at the least, it comprises a training processing section 100 which functions as a game processing section, and a transmission and reception control section 112, or the like, for controlling data transmission and reception processing with respect to the Internet. Moreover, it also comprises a home address storage section and a temporary storage section for mail address data, and the likes which is transmitted by the game-player. Numeral 30 denotes a network center of a mobile communications operator, which mediates communication between the mobile telephone device 20 and the Internet. This network center 30 comprises an electronic mail (e-mail) center 31 for managing electronic mail (e-mail).

Here, to describe the basic game procedure used in the present game, the game-player accesses a server 1 from a mobile telephone device 20, by means of a network center 30, and image information for a character training-type game and other types of image information (here, 'image information' is constituted by at least one of image data and/or text data) is delivered as game data from the character training-type game device 10 in the server 1, to the game-player's mobile telephone device 20, and the corresponding images are displayed on a monitor of the mobile telephone device 20. The game proceeds on the basis of the game-player responding by means of commands in the image displayed on the monitor (in the present embodiment, numbers corresponding to multiple-choice type options (also, simply called "options")). The response data (number data) is transmitted as game data to the game device 10, and processing for training a prescribed character (described hereinafter) is carried out as game processing, in accordance with the response data. By repeating this transmission and reception processing and training processing a prescribed number of times, finally, a training result corresponding to various abilities is determined. After a prescribed period of time has elapsed, the training result is communicated via the electronic mail (e-mail) center 31 to the mobile telephone device 20 of the game-player, in the form of a password consisting of a numerical sequence of a prescribed number of digits, for example, (may also include some text characters, or the like). As a method for communicating the training result, it is also possible to provide a notice board for the relevant address (game-player's mail address) in the electronic mail (e-mail) center 31, and write the result to this notice board in such a manner that it can be accessed and read by the game-player.

On the other hand, in the present embodiment, a direct circuit connection is not necessarily made with the present game system, but rather, the game-player has a domestic game device 40 consisting of a monitor 41 for showing game images, a game processing main section 42, and a game controller 43, whereby the domestic game device 40 uses player characters trained by the game-player using the training mode of the game device 40, and it is possible, for example, to implement a baseball game wherein the game-player competes against a team provided by the computer (one-game-player mode; there is also a two-game-player mode wherein two game controllers are connected), by loading an application program cassette 44.

On the other hand, by inputting (registering) the result for training by the character training-type game device 10 (the aforementioned password), by means of a entry input screen provided in the domestic game device 40, it is possible to cause a player character trained by the character training-type game device 10 to appear as a player character in a baseball game in the aforementioned domestic game device.

Here, one embodiment of a baseball training mode and baseball game mode based on a domestic game device 40 is described.

By loading and activating a cassette 44 in the game processing main section 42, a screen is displayed on which the aforementioned training mode, baseball game mode, or other game modes (including a mode for inputting results data for the present training game implemented using a mobile telephone device 20) can be selected, and by selecting the training mode from this mode selection screen, the present training mode is started. In other words, a new player character registration screen is displayed, whereon the name, attributes, batter and pitcher category, and a desired type of training (for instance, in the case of a batter, a No. 4 batter type, or the like) are registered. Initial values for various abilities are set for the player character, and by through the course of the actions described below, the player character is guided so that it trained into a characteristic, desired type of player character (obtaining high points for desired abilities).

When registration has been completed, the actual training procedure is started and a time in the game space of, for example, 3 years, is advanced in one week units, each time an action (various types of practice, play, rest, etc.) is instructed. Points are gained (or deducted) with respect to each command content, at a given probability, and when these commands have been given in repeated fashion during a period of three years and the prescribed training conditions are finally cleared, the player character is promoted to a major league team, to represent a training success, in other words, the player character is registered in the baseball game mode and becomes able to appear in a baseball game.

In the baseball game mode, it is possible to play a one-game-player or two-game-player mode, and if, for example, a one-game-player mode is selected, then a contest is held between a team of the computer and a game-player's team constituted by player characters which have been trained by the game-player and have been promoted to major league rank, or the like. A program is implemented whereby a baseball pitch and player characters, and the like, are shown on a screen of the monitor 41, and the player characters other than those commanded directly by the game-player are operated according to baseball rules. Here, the game program applies characteristics differentials to the actions (namely, hit, run to base, pitch, field, and the like) of both the characters which are commanded directly by the game-player and the other characters, in such a manner that they are increased or decreased on the basis of the various types of ability values obtained in the training mode.

The game-player's character on the monitor 41 screen as operated by various keys and buttons of the game controller 43 is given a bat command or run to base command, or the like, when batting, and when fielding, a pitcher character is operated until a ball is pitched, whereupon the object of control moves to the fielder positioned in the direction in which the ball is traveling, and actions are instructed to this fielder such that it performs catching and returning actions. When the ninth inning has ended, processing is performed whereby the side having the higher number of points is taken to be the winner.

Figure 2:
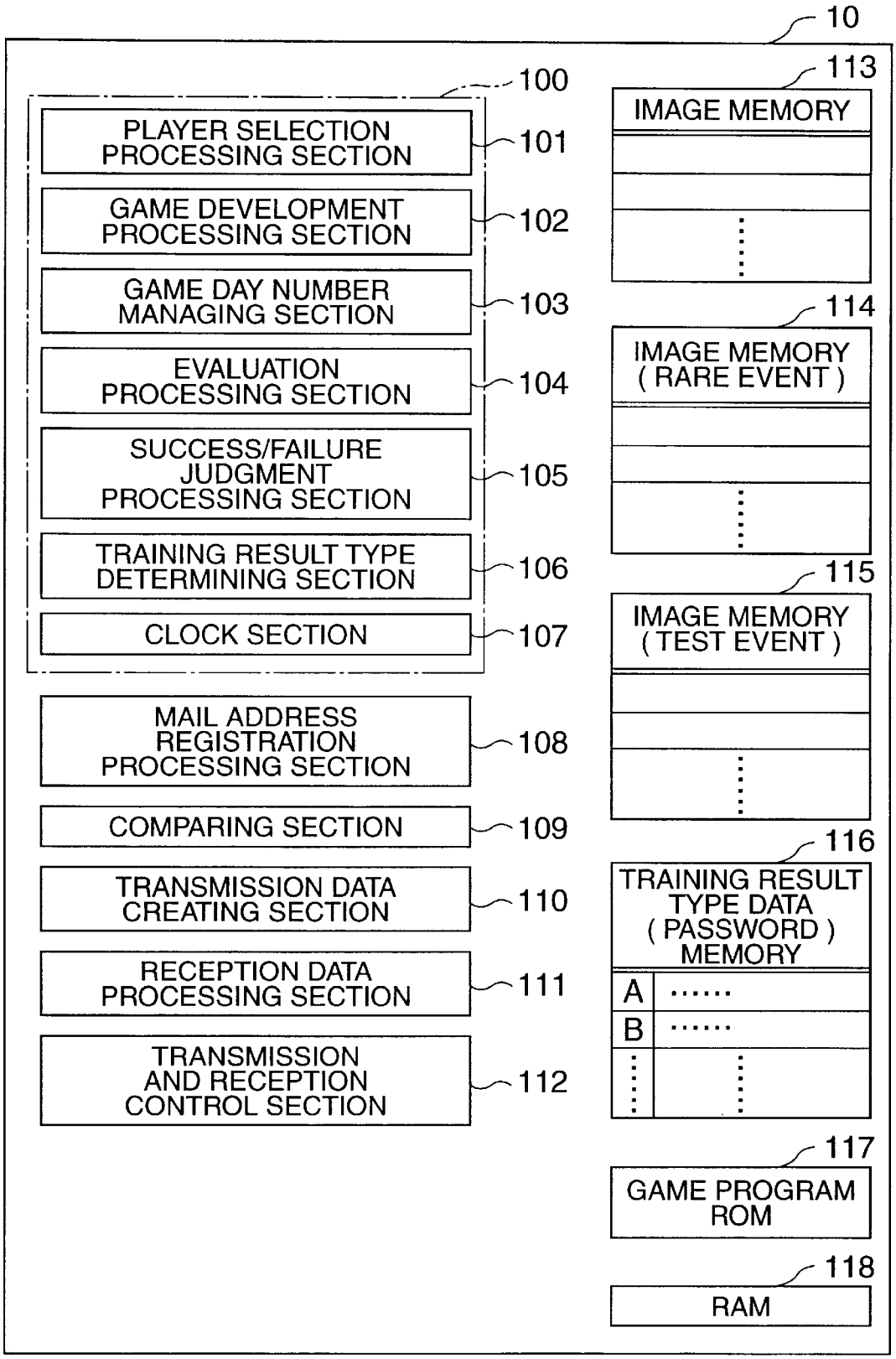
FIG. 2 is a block diagram showing one embodiment of a character training game device in a server.

Next, FIG. 2 is a block diagram of a character training-type game device 10.

There follows a description of a case where this character training game is applied to a game for training a baseball player character. In this case, the training contents include various basic abilities required in a baseball competition, such as muscular strength, agility and technique, as well as other abilities, such as batting power, running power, fielding skill, and the like, in the case of a field player character, or abilities such as shoulder strength, change ball (associated with probability of achieving strike out), and the like, in the case of a pitcher.

FIG. 2 comprises a training processing section 100 constituted by a computer, or the like, image memories 113–115 forming a data memory section, a training result type data memory 116, a ROM 117 storing a character training game program or a processing program relating to transmission and reception, as described hereinafter, and a RAM 118 for temporarily storing processing data.

The image memory 113 is a memory for storing, for a plurality of screen frames, character training image data, which comprises animated images of a character simulating a baseball player which is to be trained, (image data; in the present embodiment, comprises still images), and text data which comprises multiple choice-type option numbers and related option contents corresponding to the character training image data. In the present embodiment, image data for approximately 60 frames is stored. It is also possible to create no correspondences between the character training image data and the option contents, or to associate same by an appropriate prescribed correlation, or in a random manner.

The image memory 114 is a memory for storing character training image data and options contents (hereinafter, called event screen data,) prepared for specific events, in a mutually corresponding fashion. The image memory 115 is a memory storing test image data and test contents (hereinafter, called test screen data,) prepared for the final questions of the set number of questions for each day (described hereinafter).

The training result type data memory 116 is a memory for storing training results determined at the time that a previously set number of questions has been completed, and stored as type data representing ability values for trainee player characters of a plurality of different types. For example, there may be four types of player character, type A-type D, for both fielders and pitchers, respectively, the related type data being represented by a password consisting of a symbol, such as a number having a prescribed number of digits, or the like. If the number of digits is large, then it is possible to prepare a large number of different training result types. To look at one example of training result types, the fielder types may comprise power hitters, player characters with high safe hit ability, player characters with high defensive ability, player characters with high running power, and the like. The pitcher types may comprise player characters with strengths as fast ball pitchers, soft ball pitchers, relief specialists, or special batters (for example, left-handed batters), and the like.

Furthermore, the training processing section 100 comprises: a player selection processing section 101, a game development processing section 102, an evaluation processing section 103, a game day number managing section 104, a success and failure judgment processing section 105, a clock section 106 and a training result type determining section 107.

The player selection processing section 101 performs processing for determining the trainee player character, in a case where either a fielder or pitcher has been selected (at the aforementioned mobile telephone device 20) as the character to be trained.

The game development processing section 102 reads out one item of screen data and event screen data selected according to a prescribed correlation, or selected randomly, from the image memories 113, 114, or it reads out the final test screen data for a day.

The game day number managing section 103 performs processing whereby one day of the timeframe in the game space is considered to have passed, each time the image data-test screen data is selected, and in addition to causing said selection processing to be performed for 60 days of the game space timeframe, it also manages the number of days in the game space timeframe, in such a manner that 15 days of the game space time are set for each one day of real time, in other words, the present training game is performed over four days of real time.

The evaluation processing section 104 reads in response data transmitted from the mobile telephone device 20 in accordance with the aforementioned image data-test screen data, and determines a score from the option contents and the response data, whilst also adding this score to the previously aggregated value. In the present embodiment, three types of value, namely, "+1", "0", "−1" are set as scores, for example, each one of these scores being associated with a response data item relating to an option data item, or being determined without regard to the response data, or in a random manner. Furthermore, when 15 days of the game space time has passed, the evaluation processing section 104 determines whether or not the aggregate value has reached a prescribed clear condition value, and if it has not reached this clear condition value, then the game is terminated compulsorily and a training failure is inferred, whereas if it has reached the clear condition value, then the training game can be continued for the next 15 days of the game space timeframe.

The success and failure judgment processing section 105 judges whether or not the aggregate value has reached a prescribed success condition value, when the final 15-day period of the game space time has ended at the fourth day in real time, and if it has not reached this success condition value, then a training failure is inferred, whereas if it has reached the success condition value, then a training success is inferred and judgment processing is instructed to the training result type determining section 106. It is also possible for the training failure conditions to include, as judgment data and conditions, for example, whether a prescribed option (for instance, the "play" option displayed at different questions) has been selected a set number of times or more, or conversely, whether a prescribed option (such as a specific practice menu) has not been selected a set number of times or more, or whether a prescribed event has been generated, or how many times it has been generated.

The training result type determining section 106 selects the training result type corresponding to the final aggregate value, and it may perform this either by selecting a training result type which takes account of the history of response data, or conversely, by selecting a training result type without regard to this data, or in a random manner.

The clock section 107 counts the real time and monitors that the training game for 15 days of the game space time is not executed continually within one day of real time, whilst also performing time management whereby the clear status results and the training result type transmitted to the game-player when 15 days of training in the game space timeframe has been completed, and when the present training game is finally completed, are notified to the game-player after a prescribed period of time, for example, four weeks, has passed after each respective time of completion.

A mail address registration processing section 108 conducts processing for instructing a game-player's mail address input guide screen, when the present training game is started, and for registering a mail address input from the game-player's mobile telephone device 20, in association with, for instance, the 19-digit fee charging ID code of the mobile telephone device 20.

A comparing section 109 compares the aforementioned ID code read in when starting the present training game with an ID code read in when making access to continue the game on a subsequent day, whereby it compares the history of game development up to that point and causes an appropriate game to be implemented thereafter.

A transmission data creating section 110 creates guide screens of various types (for example, the aforementioned mail address input guide), the screen data and test screen data, and reads out clear status notification screens and training result notification screens, and the like, during the game from a prescribed memory, converting same into transmission data, in other words, i mode GIF format images. A received data processing section analyzes various data transmitted by a mobile telephone device 20, and transfers the data to a processing section as required or stores the data in RAM 118 or the like.

A transmission and reception control section 112 implements data communication to and from the mobile telephone device 20, and performs packet processing for transmitting the clear status and training results to the e-mail center 31.

Figure 3:
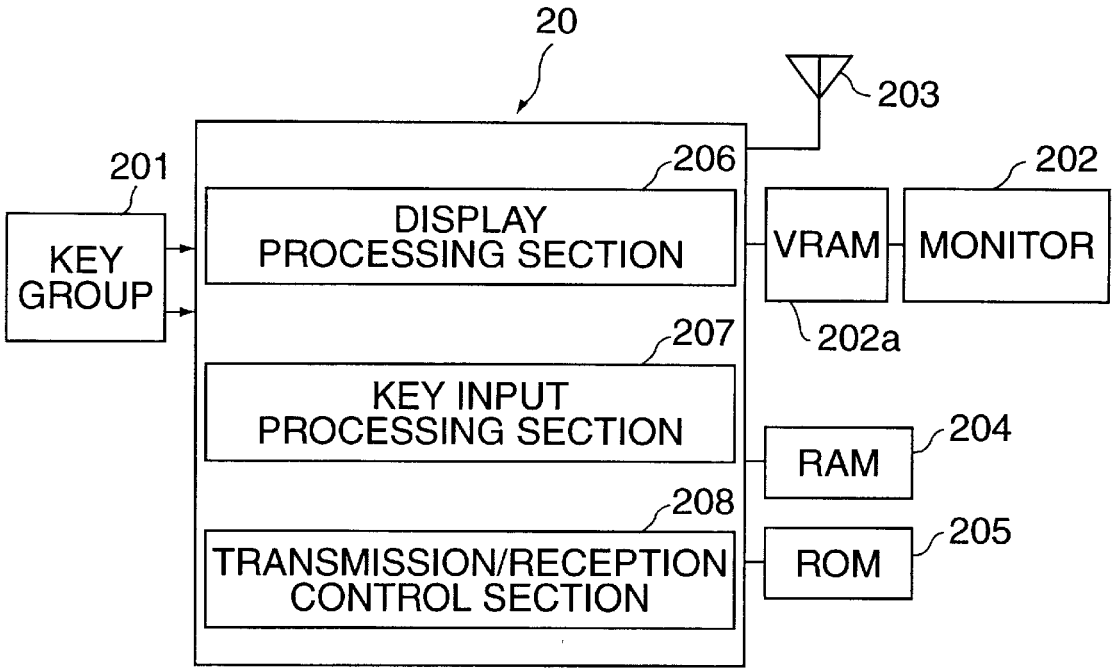
FIG. 3 is a block diagram of a mobile telephone.

FIG. 3 shows a block diagram of a mobile telephone device 20, extracting and describing, in particular, only those functions which are required in the present invention. The mobile telephone device 20 comprises a control section consisting of a computer for coordinating and controlling the respective sections, and this control section is constituted by a key group 201 forming an operating member, a VRAM 202*a* for storing image data to be displayed on a monitor 202, an antenna 203, a RAM 204 for temporarily storing input data and processing data, and a ROM 205 for storing control programs, and the like.

The key group 201 comprises number keys for inputting telephone numbers, various function keys, circuit on/off switching keys, and the like. It is also composed such that, by setting the function keys, text characters can be input using the number keys, thereby enabling input of mail data or input of mail addresses.

The VRAM 202*a* temporarily stores screens displayed on the monitor 202, which is constituted by a liquid crystal display device, or the like, and by reading out the contents written to the VRAM 202*a* and displaying same on the monitor 202, in a repeated fashion at prescribed intervals, it is possible to view same as a still image, due to a latent image effect.

Describing the display processing section 206—transmission and reception control section 208 constituting the control section, the display processing section 206 causes a confirmation display of input operations, a display of various input guide screens, and display of image data transmitted from the character training-type game device 10 to be shown on the monitor. Moreover, it also causes mail contents to be displayed. This display processing section 206 has capacity at the least for storing the image data for one screen frame or more, and in a mode where, for example, only a portion of an image can be displayed on the monitor 202, then it is devised that the image can be scrolled upwards and downwards, or the like, by operation of particular keys of the key group 201, in such a manner that the whole of the image can be viewed. The key input processing section 207 creates information corresponding to the operation of the key group 201.

The transmission and reception control section 208 controls reception and transmission circuits connected to a normal wireless subscriber circuit, processes transmission and reception of sound data, and also processes transmission and reception of data in electronic mail used when operating via the Internet, or the like. Transmitted data is received via the antenna 206. Image data transmitted or received by the mobile telephone is compressed to GIF format before transmission in packets.

Figure 4:
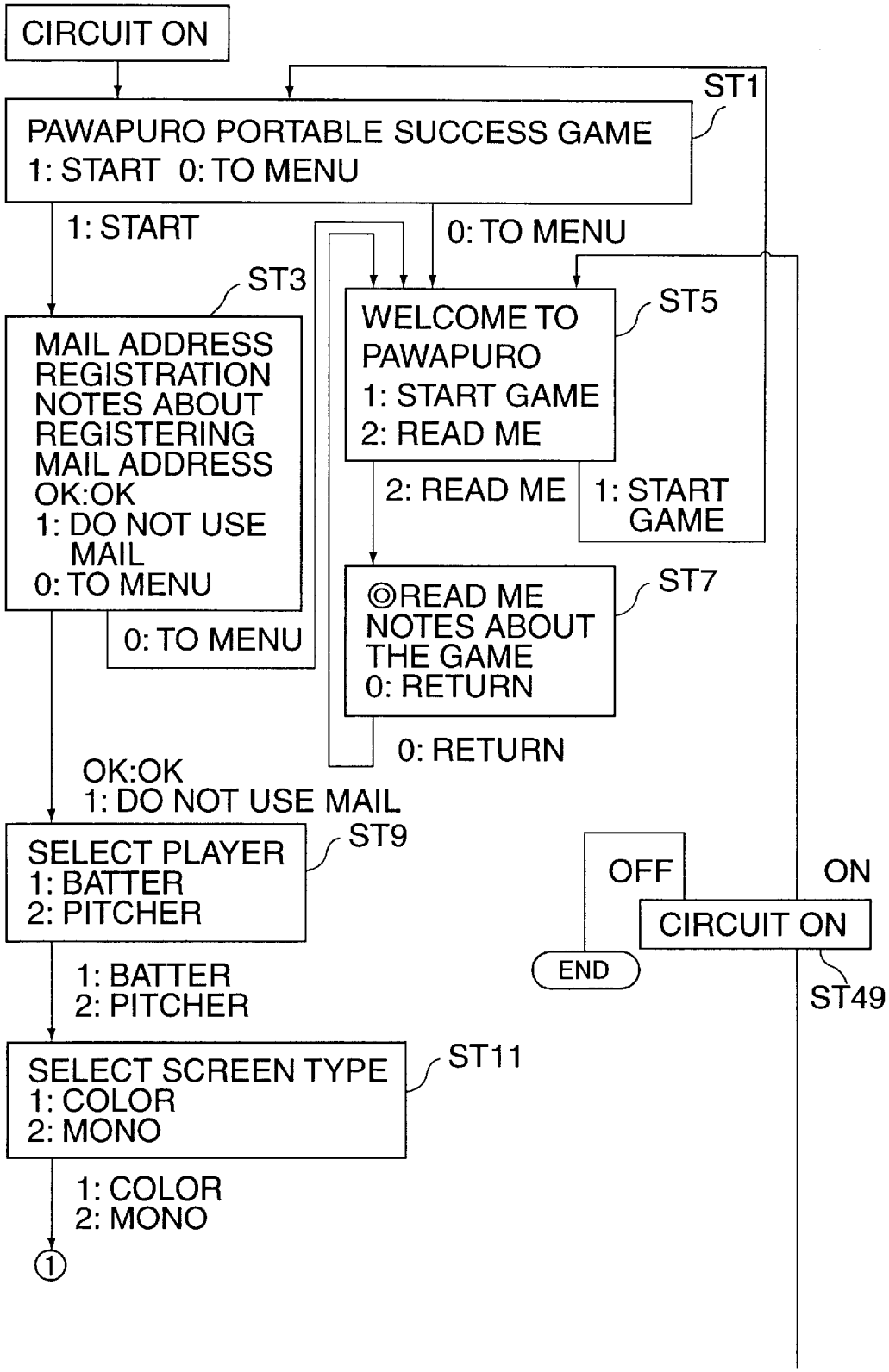
FIG. 4 is a diagram showing a flowchart illustrating a game procedure.
Figure 5:
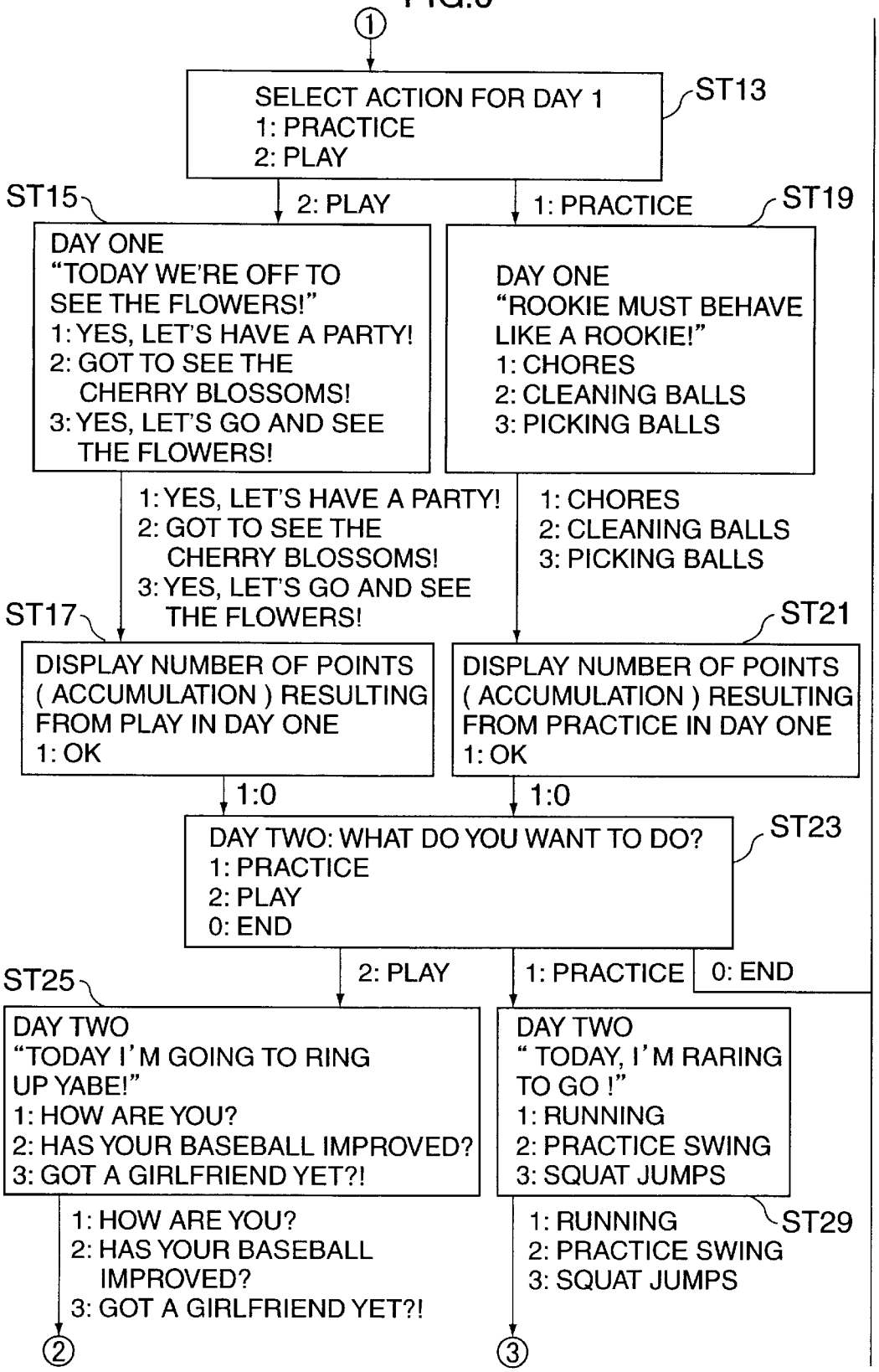
FIG. 5 is a diagram showing a flowchart illustrating a game procedure.
Figure 6:
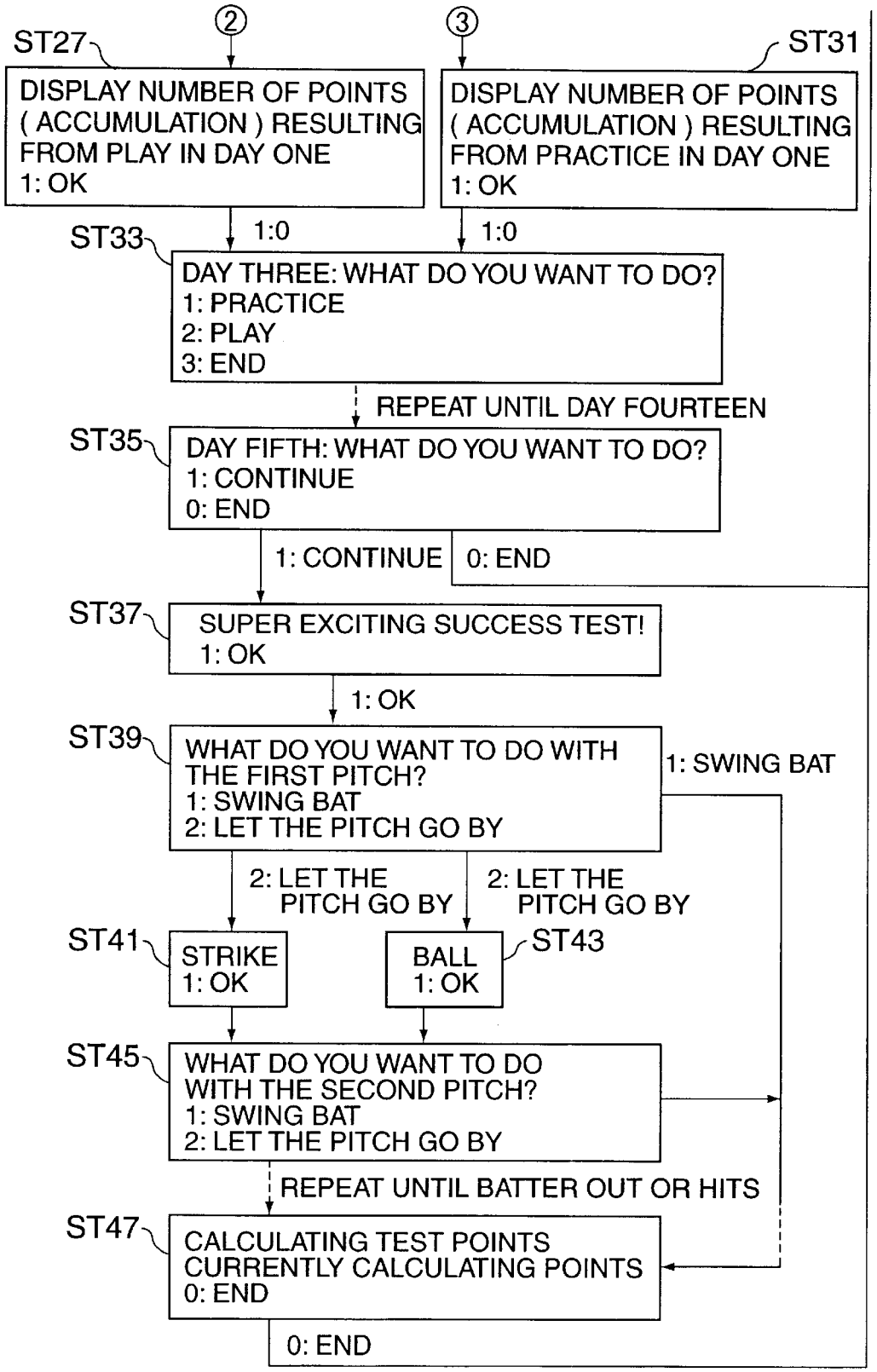
FIG. 6 is a diagram showing a flowchart illustrating a game procedure.

Next, a game procedure relating to the composition above will be described. FIG. 4 to FIG. 6 are flowcharts illustrating the procedural sequence of the present character training-type game.

In FIG. 4, inside of an inner rectangle, the words in Japanese Hiragana appear, it is basically a name of the game "Pawapuro-kun Keitai Sakusesu" which cannot find a direct English translation. However, it closely means to say Power "Pro Portable Success". The words are registered trademark in Japan.

Figure 7:
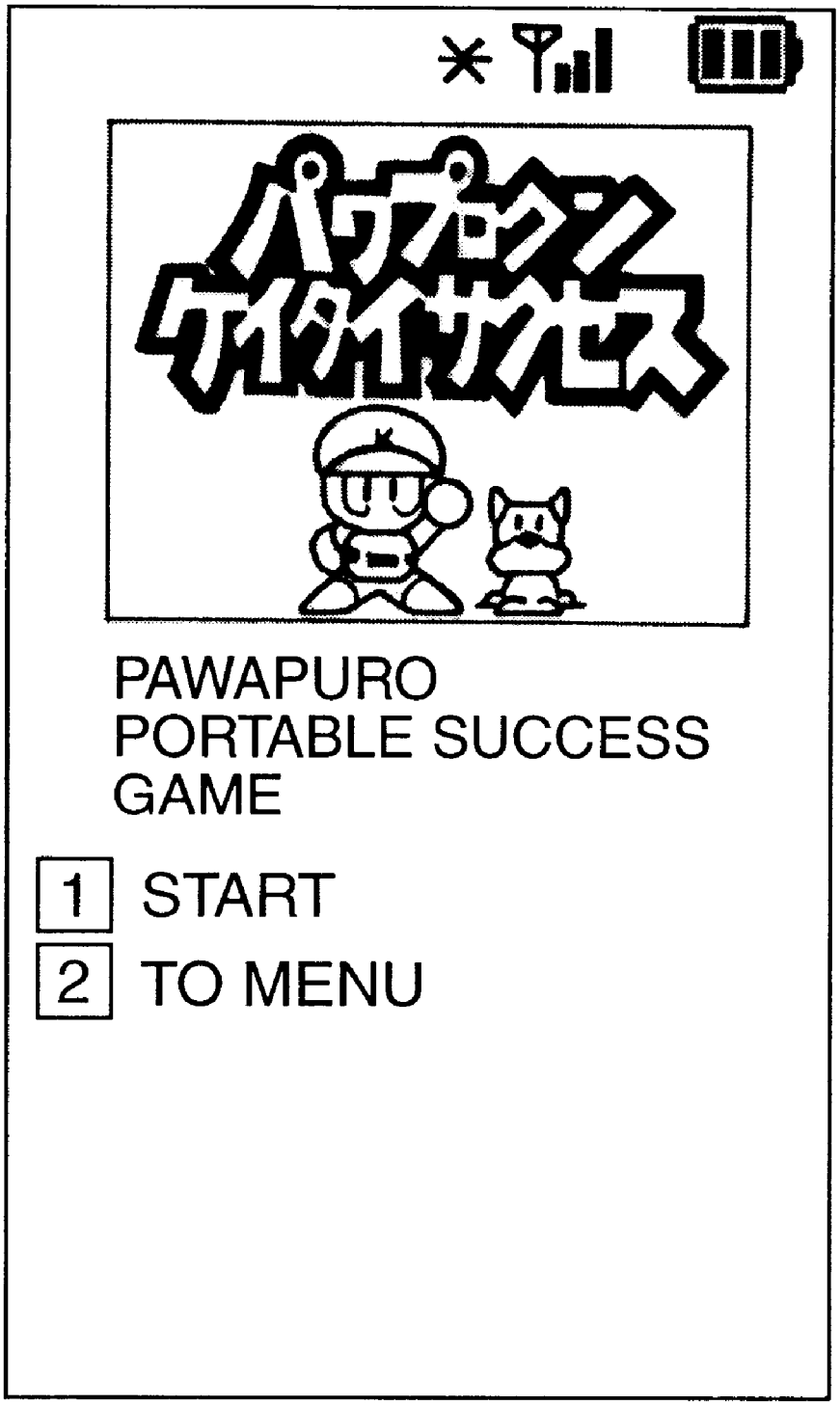
FIG. 7 is a diagram showing one example of a game start screen displayed on a monitor.

Firstly, when a home page address of the character training-type game device 10 in the server 1 is input by the game-player via the mobile telephone device 20, this is received by the device 10 which starts processing for delivering prescribed data in order to start a game. In other words, start screen data as illustrated in FIG. 7 is sent to the mobile telephone device 20 (step ST1). On the start screen in FIG. 7, a two choice screen "1: Start" and "2: Menu" is displayed on the monitor 202. Here, if response data indicating that "1: Start" has been selected on the mobile telephone device 20, (in other words, response data of "1") is received, then the procedure moves to step ST3, whereas if response data indicating that "2: Menu" has been selected on the mobile telephone device 20, (in other words, response data of "2") is received, then a "Welcome to Pawapuro!" screen is transmitted, and a further two choice screen comprising "1: Start Game" and "2: Read me" is displayed on the monitor 202 (step ST5).

Here, is "1" is received as response data, then the sequence returns to step ST1, whereas if "2" is received as response data, then notes relating to the game are displayed and in the final line, "0: Return" is displayed as a command prompt (step ST7).

At step ST3, "Mail address registration" is displayed along with cautionary notes, and a three-choice screen comprising "OK: OK", "1: Proceed without using mail", "0: Menu", is also displayed. Here, the sequence moves to step ST9, unless "0" is received as response data.

At step ST9, a two-choice screen comprising "1: Batter", "2: Pitcher" is displayed as a "Select Player" screen. If either "1" or "2" is received as response data, then subsequently, a two-choice screen comprising "1: Color" and "2: Mono" is displayed as a "Select screen type" screen (step ST11). If either "1" or "2" is received as response data, then the game is actually started.

Figure 8:
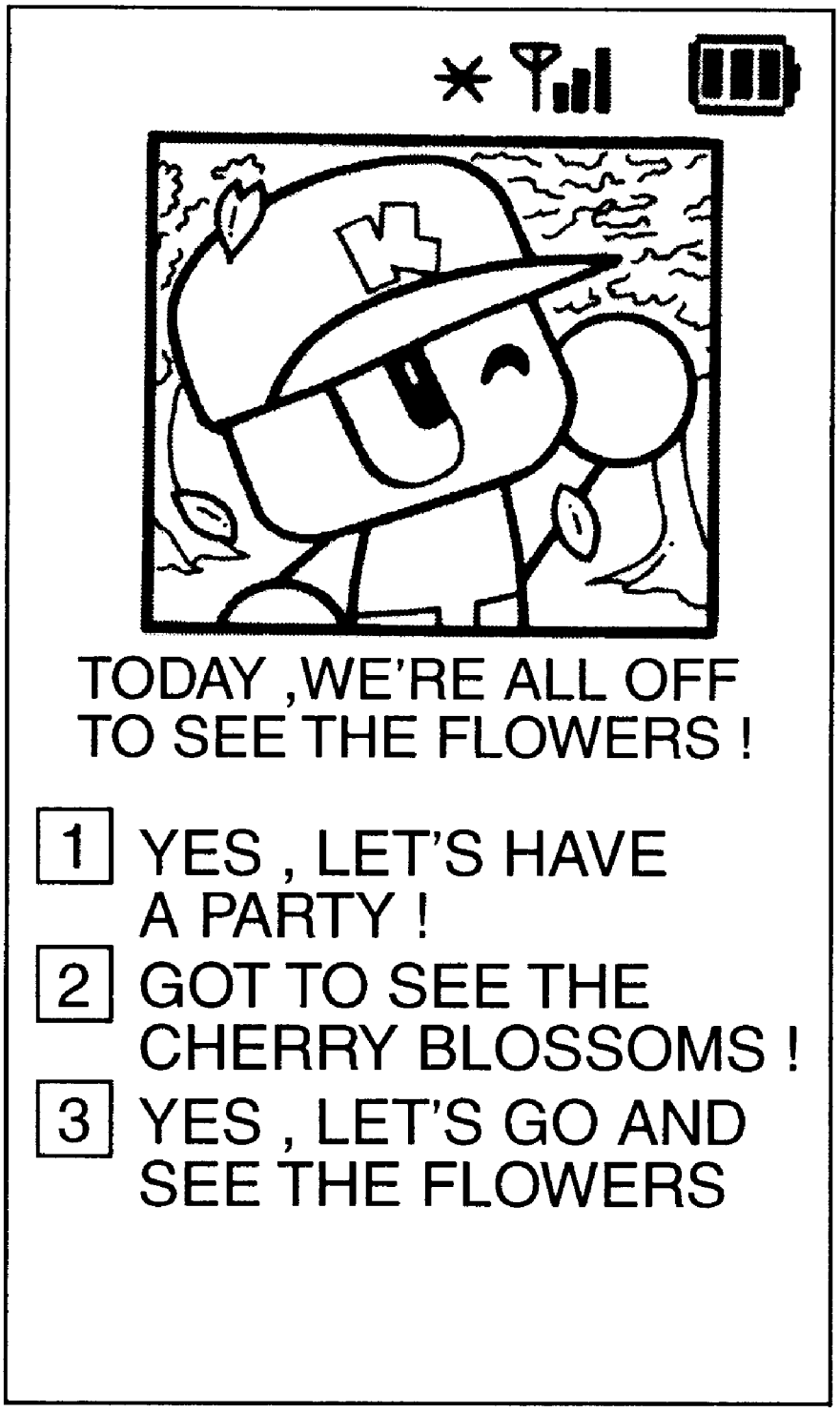
FIG. 8 is a diagram showing one example of a monitor screen in a case where "Play" has been selected.

Specifically, a two-choice screen comprising the text "Select action for day one" and the options "1: Practice" and "2: Play" is displayed (step ST13). Here, if "2" is received as response data, then a three-choice screen relating to recreation time is displayed as shown in FIG. 8, for example, comprising the title "Today we're all off to see the flowers!", and the options "1: Yes, let's have a party!", "2: Got to see the cherry blossoms!", "3: Yes, let's go and see the flowers" (step ST15). Here, if either "1," "2" or "3" is received as response data, then a previously set score is determined on the basis of this response data, or a score is determined randomly, and this score is transmitted to the mobile telephone device 20 and displayed on the monitor 202 (step ST17). With this, the action for one day in the game space timeframe is completed. Thereupon, when response data "1" is received in response to the text "1: OK" on the score screen, the procedure moves to step ST25.

Figure 11:
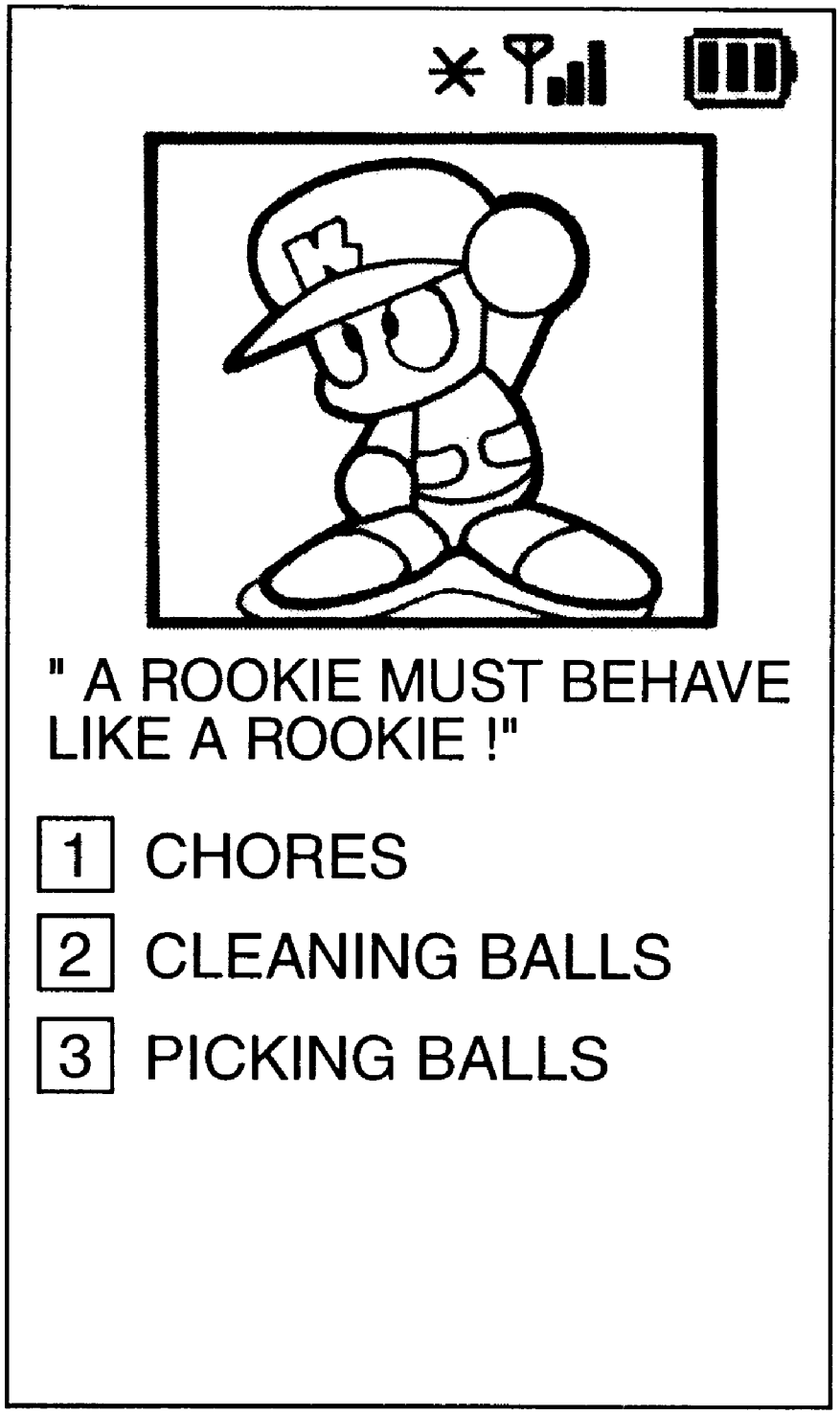
FIG. 11 is a diagram showing one example of a monitor screen in a case where "Practice" has been selected.

If, on the other hand, "1" is received as response data at step ST13, then as shown in FIG. 11, for example, a three-choice screen relating to practice is displayed, comprising a title "Rookie must behave like a rookie!", and the options "1: Chores", "2: Cleaning balls", "3: Picking balls" (step ST19). Here, if either "1", "2" or "3" is received as response data, then a previously set score is determined on the basis of this response data, or a score is determined randomly, and this score is transmitted to the mobile telephone device 20 and displayed on the monitor 202 (step ST21). Thereupon, when response data "1" is received in response to the text "1: OK" on the score screen, the procedure moves to step ST25.

Figure 9:
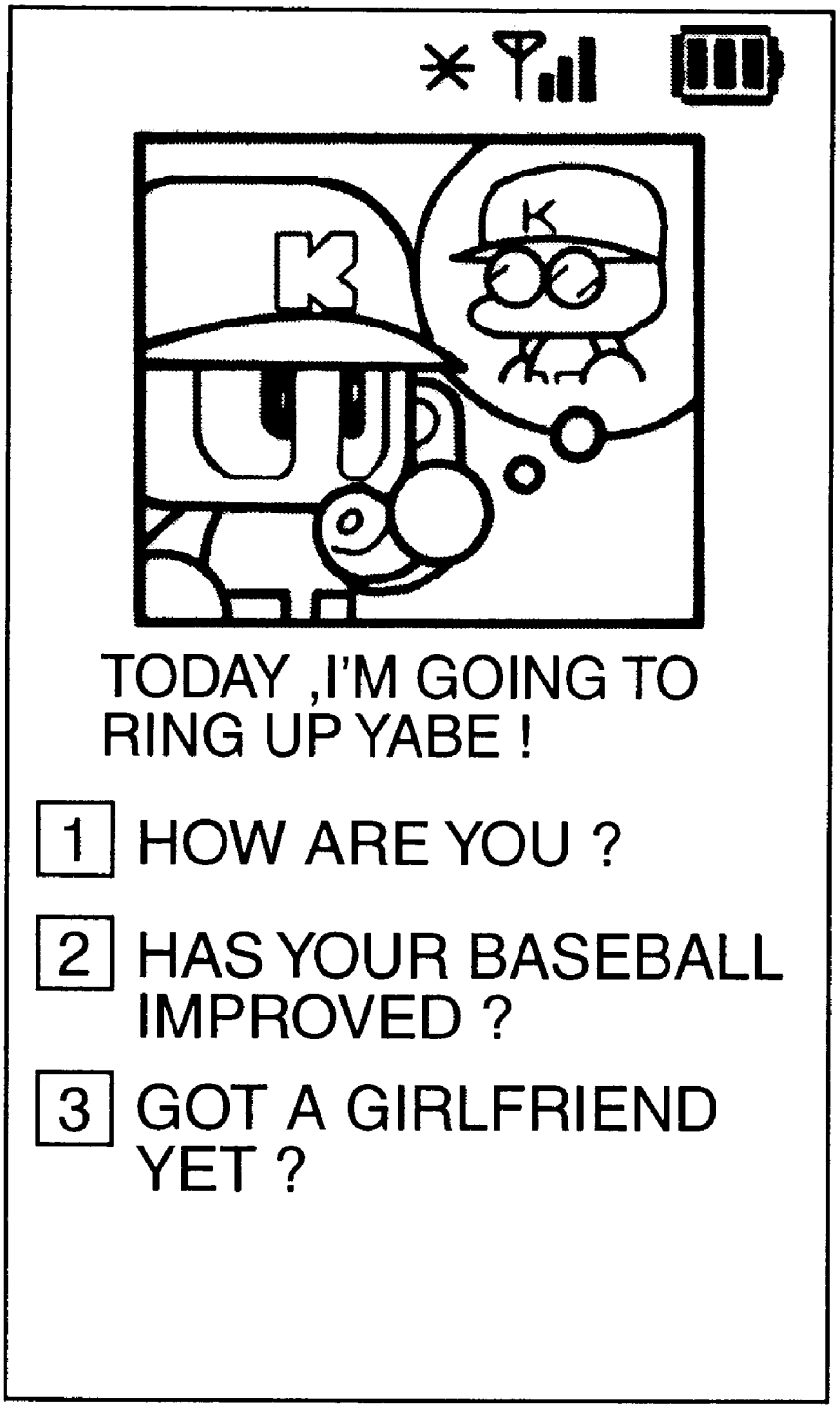
FIG. 9 is a diagram showing a further example of a monitor screen in a case where "Play" has been selected.

At step ST25, a three-choice screen is displayed, comprising the text "Day 2: What do you want to do?" and the options "1: Practice", "2: Play" and "3: End" (step ST23). Here, if "2" is received as response data, then a three-choice screen relating to recreation time as illustrated in FIG. 9, for example, is displayed, comprising the title "Today, I'm going to ring up Yabe!" and the options "1: How are you?", "2: Has your baseball improved?" and "3: Got a girlfriend yet?!" (step ST25). Here, if either "1" "2" or "3" is received as response data, then a previously set score is determined on the basis of this response data, or a score is determined randomly, this value is added to the previous value, and the aggregate value is transmitted to the mobile telephone device 20 and displayed on the monitor 202 (step ST27). With this, the action for day 2 in the game space timeframe is completed. Thereupon, when response data "1" is received in response to the text "1: OK" on the score screen, the procedure moves to step ST33.

Figure 12:
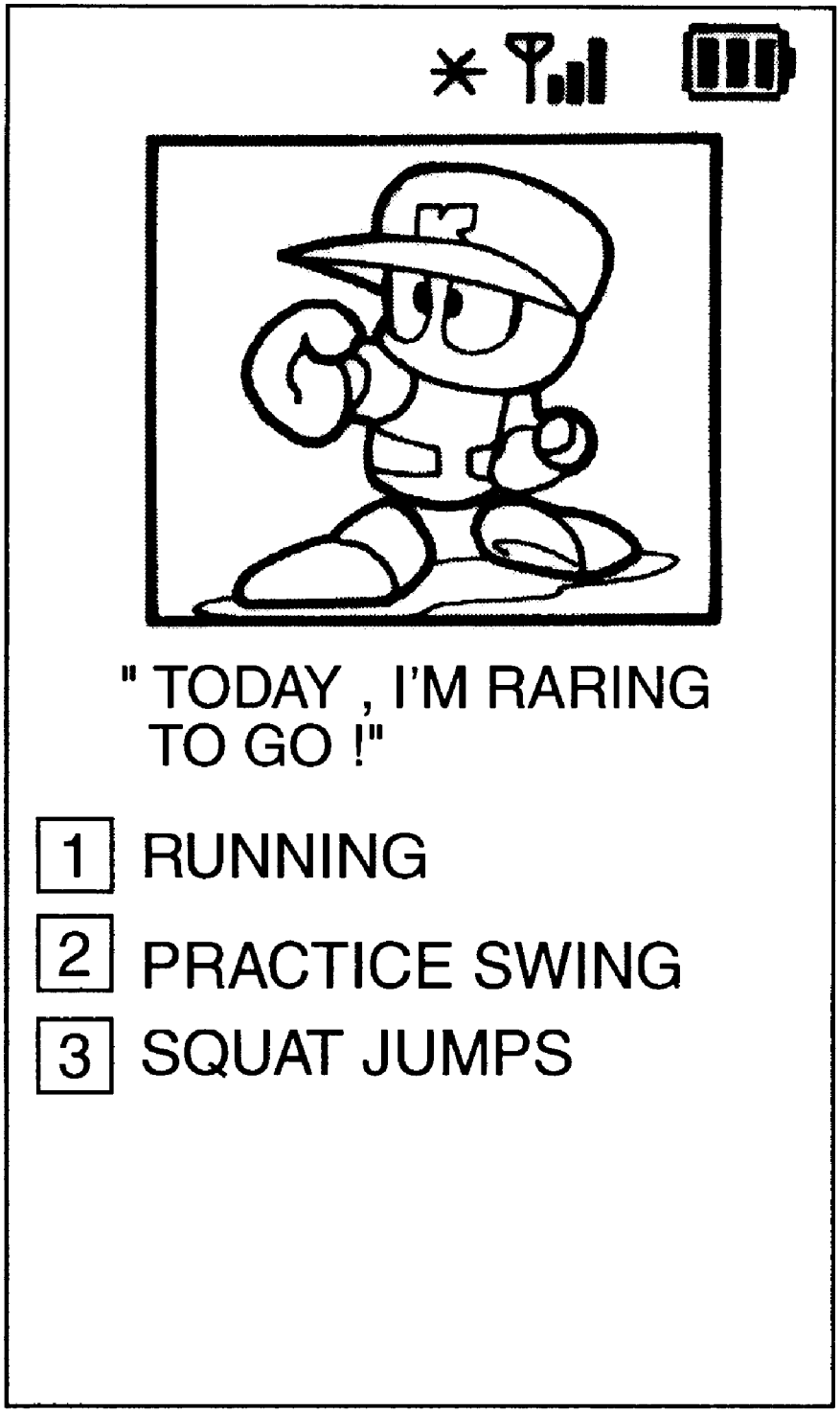
FIG. 12 is a diagram showing a further example of a monitor screen in a case where "Practice" has been selected.

If, on the other hand, "1" is received as response data at step ST23, then a three-choice screen as shown in FIG. 12, for example, is displayed, comprising the title "Today, I'm paring to go!" and the options "1: Running" "2: Practice swing", and "3: Squat jumps" (step ST29). Here, if either "1", "2" or "3" is received as response data, then a previously set score is determined on the basis of this response data, or a score is determined randomly, this value is added to the previous value, and the aggregate value is transmitted to the mobile telephone device 20 and displayed on the monitor 202 (step ST31). With this, the action for day 2 in the game space timeframe is completed. Thereupon, when response data "1" is received in response to the text "1: OK" on the score screen, the procedure moves to step ST33. If "3" is received as response data, then it is inferred that the game-player wishes to terminate the game at an intermediate stage, and hence at step ST49, it is confirmed that the circuit is to be turned off, and the whole procedure of the present game is terminated.

Figure 10:
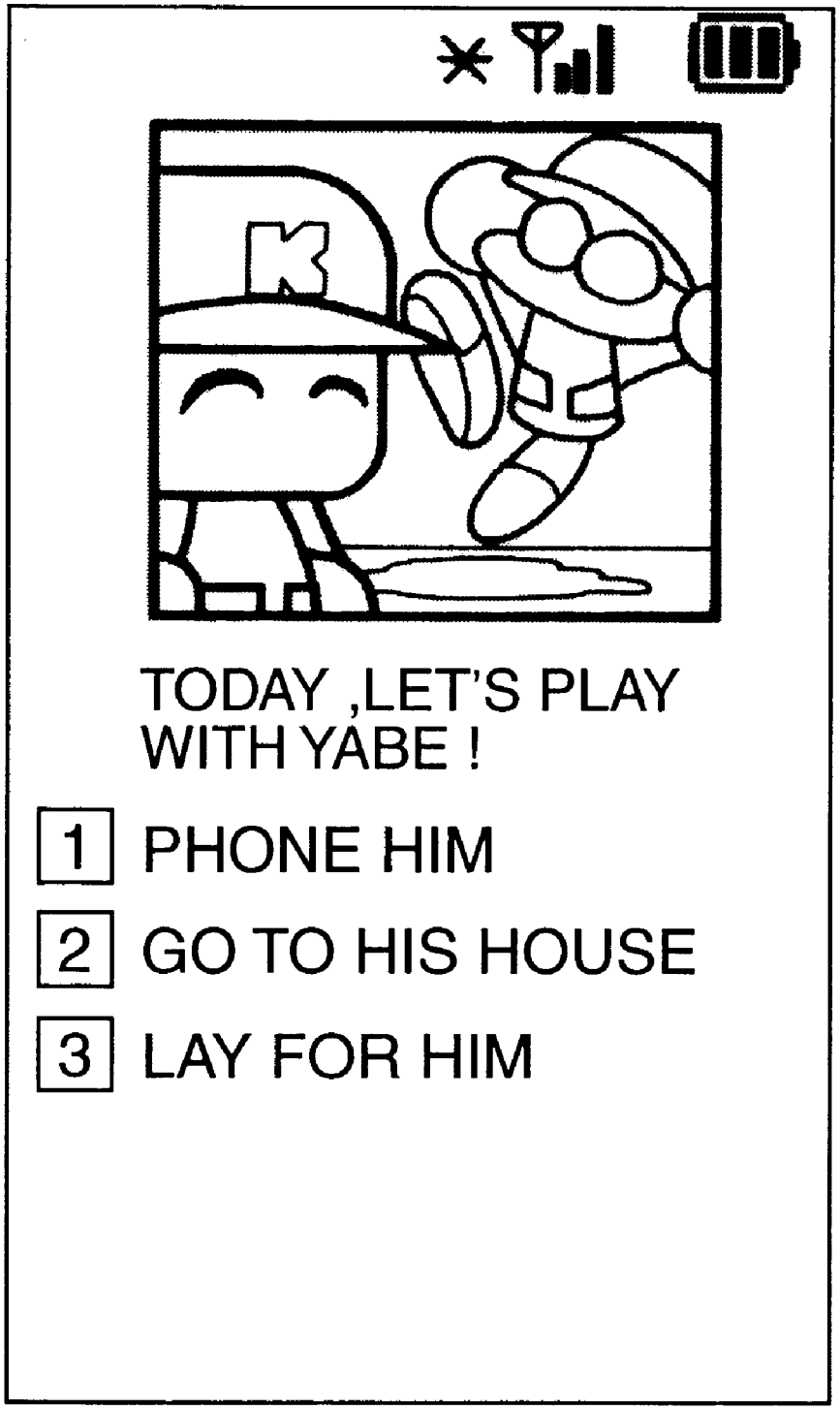
FIG. 10 is a diagram showing a further example of a monitor screen in a case where "Play" has been selected.
Figure 13:
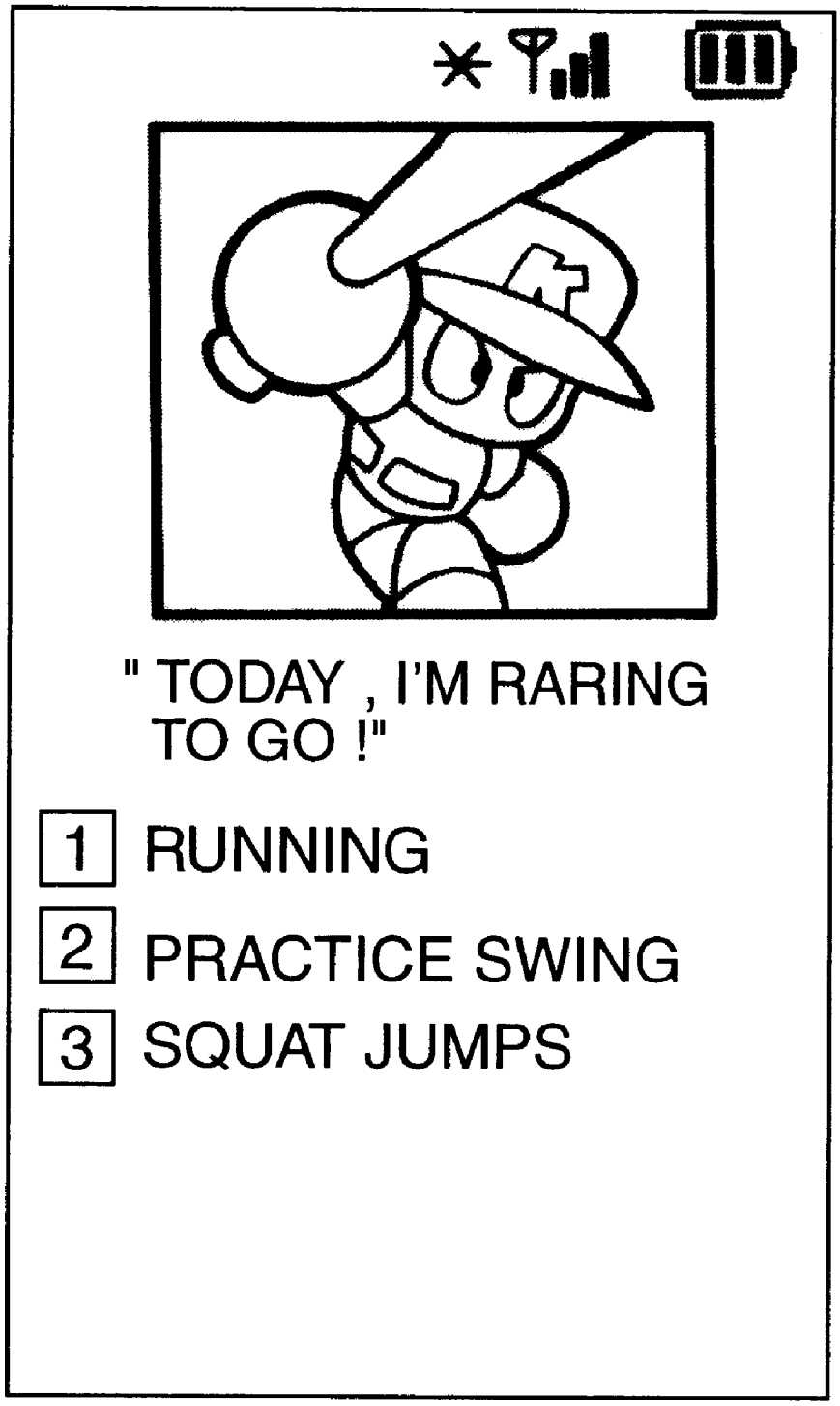
FIG. 13 is a diagram showing a further example of a monitor screen in a case where "Practice" has been selected.
Figure 14:
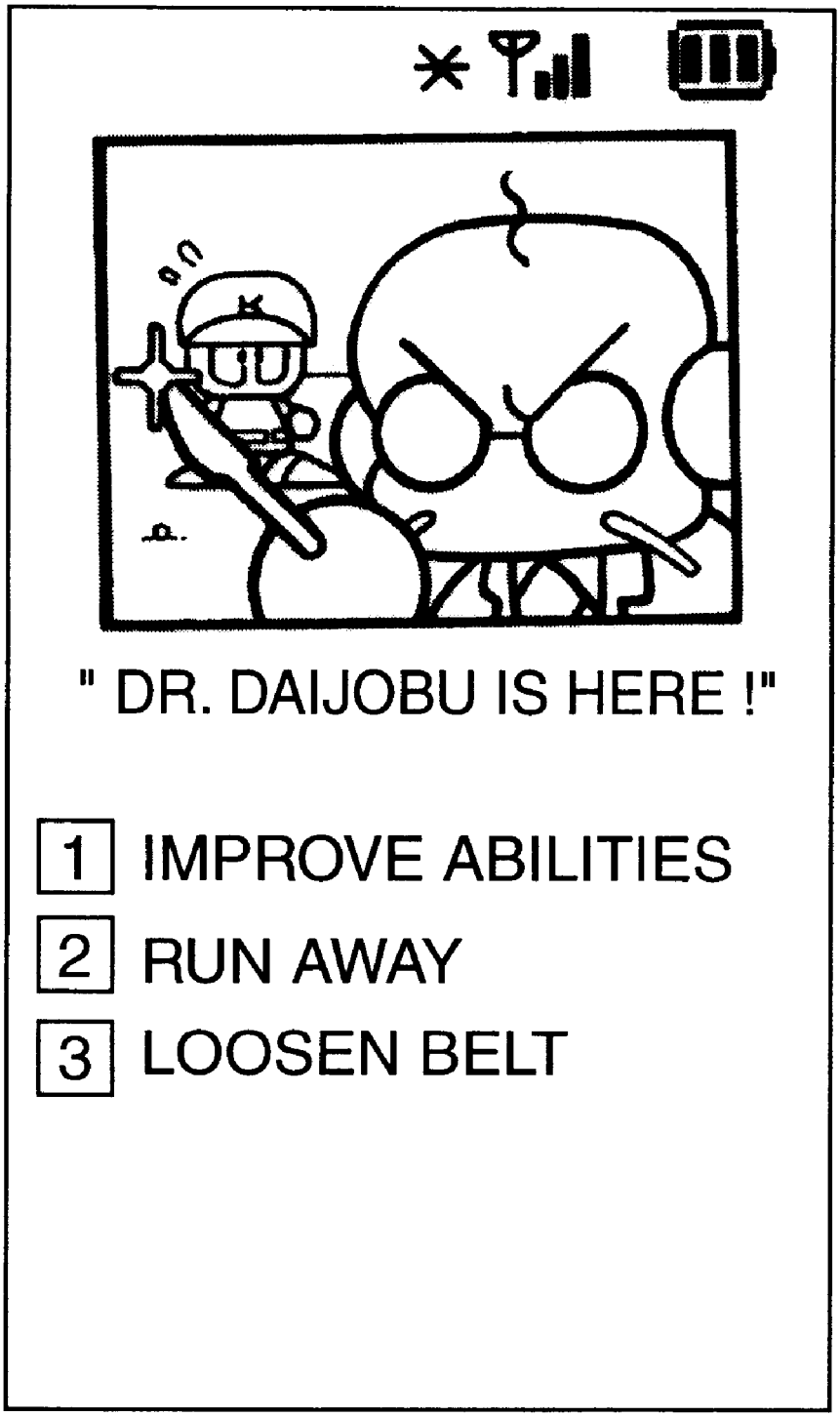
FIG. 14 shows one example of a monitor screen in a case where an event has been generated.
Figure 15:
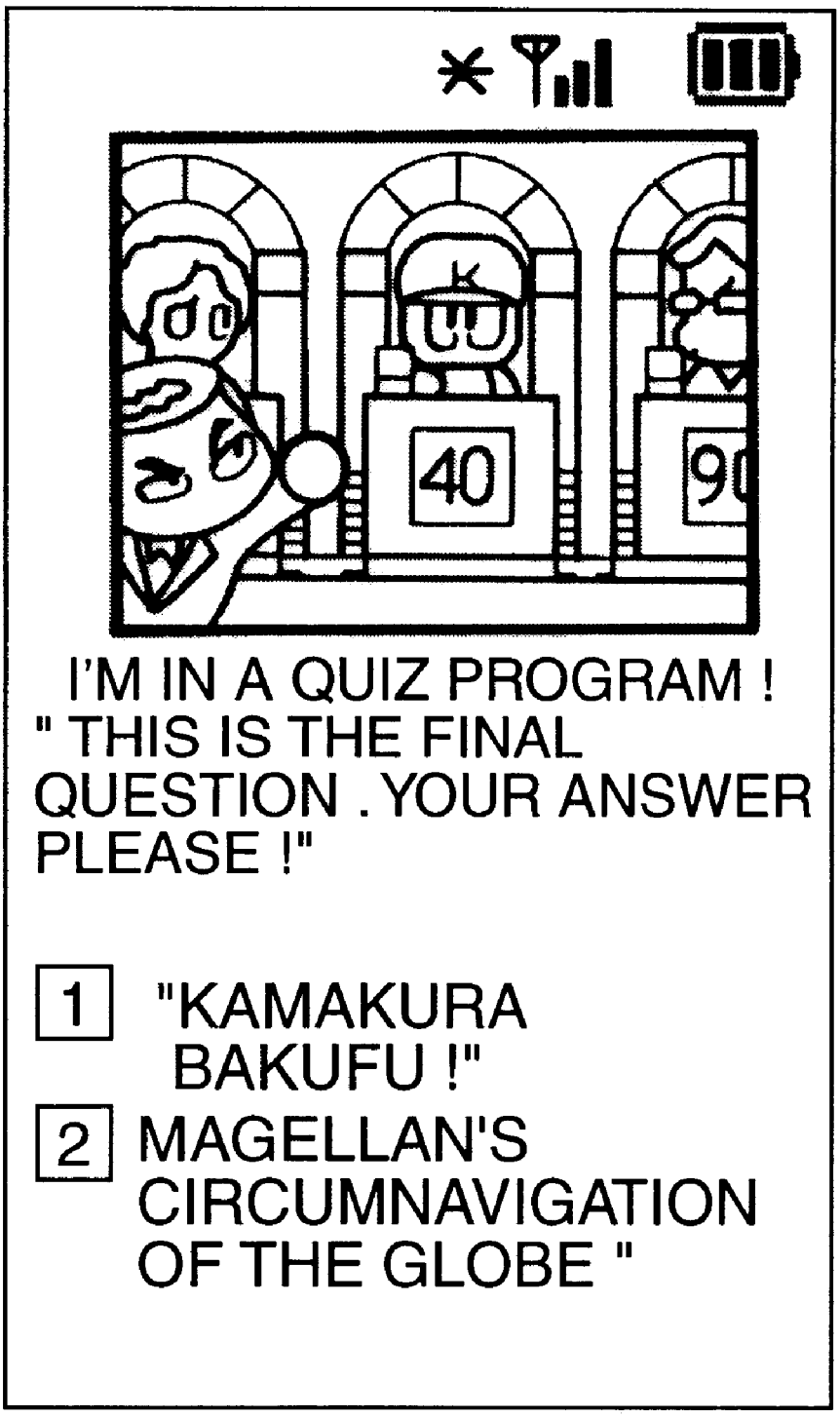
FIG. 15 shows one example of a monitor screen in a case where an event has been generated.
Figure 16:
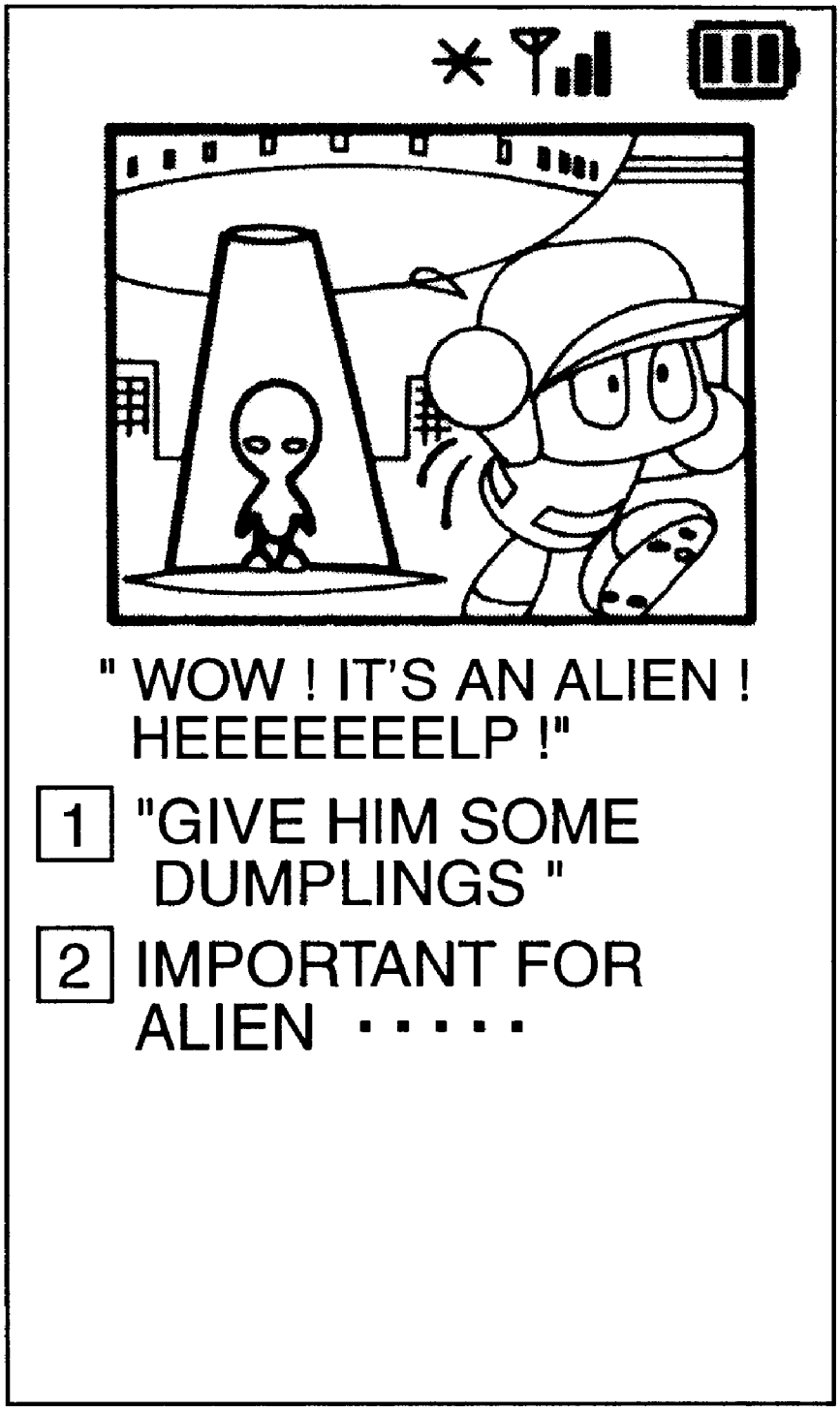
FIG. 16 shows one example of a monitor screen in a case where an event has been generated.

At step ST33, a three-choice screen is displayed, comprising the text "Day 3: What do you want to do?" and the options "1: Practice", "2: Play" and "3: End" and the procedure as illustrated in step ST23–step ST31 is repeated. During this procedure, in other words, from the fourth day to the fourteenth day in the game space timeframe, each screen information item is selected from the image memory 113 according to a certain correlation, or in a random manner. For example, a play screen as illustrated in FIG. 10 or a practice screen as illustrated in FIG. 13 may be displayed. Moreover, an event screen is selected from the image memory 114 between the first day and the fourteenth day, according to a certain correlation, or in a random manner. Examples of event screens are shown in FIG. 14 to FIG. 16. FIG. 14 is a three-choice screen comprising the title "Dr. Daijobu is here!" and the options "1: Improve abilities", "2: Run away", "3: Loosen belt" FIG. 15 is a two-choice screen comprising, for example, the title "I'm in a quiz program. 'This is the final question. Your answer please!'" and the options "1: Kamakura Bakufu" and "2: Magellan's circumnavigation of the globe". FIG. 16 is a two-choice screen comprising, for example, the title "Wow! It's an alien! Heeeeeeelp!" and the options "1: Give him some dumplings!" and "2: Important for Alien???". A score is set for each options of each question and scores are obtained in an aggregated fashion in accordance with each option selected.

In this way, as the game proceeds to day 15 in the game space timeframe, on the next screen, the text "Day 15: What do you want to do?" is displayed, along with a two-choice screen "1: Continue" and "0: End" (step ST35).

Figure 17:
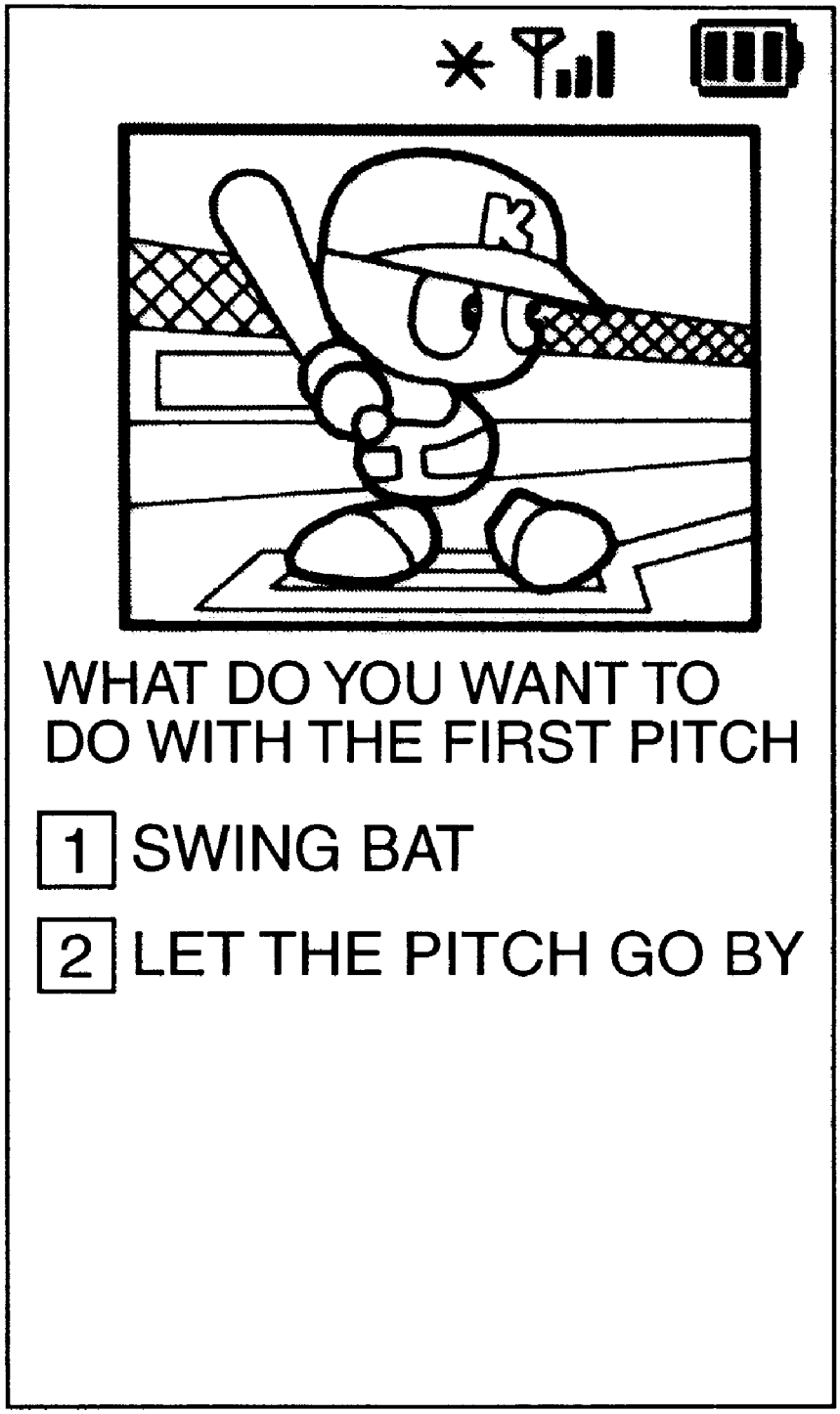
FIG. 17 shows one example of a monitor screen in a case where "Test" (batter) has been selected.

Here, if "1" is received as response data, then the headline "Super Exciting Success Test" and the selection screen "1:

OK" are displayed (step ST37), and here, if "1" is received as response data (step ST37), then in cases where the trainee character is a fielder (batter selected as step ST9), then the test screen illustrated in FIG. 17 is read out from the image memory 115 and displayed (step ST39). The test screen comprises an image of a player character standing at the batting plate, and a two-choice screen consisting of the guide text "What do you want to do with the first ball?" and the two-choice screen "1: Swing bat", "2: Let the pitch go by". Here, if "2: Let the pitch go by" is received as response data, then it is supposed that a ball has been pitched by a pitcher located off the screen, and it is judged whether that pitch is a strike or a ball. In other words, if it is a strike, then on the subsequent screen, the text "Strike" and a selection screen "1: OK" are displayed (step ST41), whereas if it is a ball, then on the subsequent screen, the text "Ball" and a selection screen "1: OK" are displayed (step ST43). Here, when "1" is received as response data on either or the screens, a two-choice screen is displayed comprising the guide text "What do you want to do with the second ball?" and the options "1: Swing bat" and "2: Let the pitch go by" (step ST45). In other words, if "2: Let the pitch go by" is selected in a consecutive fashion, then the screens at steps ST39 and ST45 are displayed repeatedly, and ultimately, either three strikes or four balls is judged and the procedure moves to step ST47. It is also possible to devise that the a four balls result is not generated (in other words, if all pitches are left, then finally, a strike-out occurs.)

On the other hand, if "1" is received as response data at the screens at step ST39 or ST45, then it is determined whether the result is a hit or an out. In this way, when it is finally decided to be a hit or an out (including three strikes), day 15 is concluded, the procedure moves to acquired points processing, and a selection screen containing the guide text "Obtaining test points . . . Currently obtaining points" and the option "0: End" is displayed. If "0" is received as response data, then at step ST49, the circuit is switched off and the current procedure is terminated.

Figure 18:
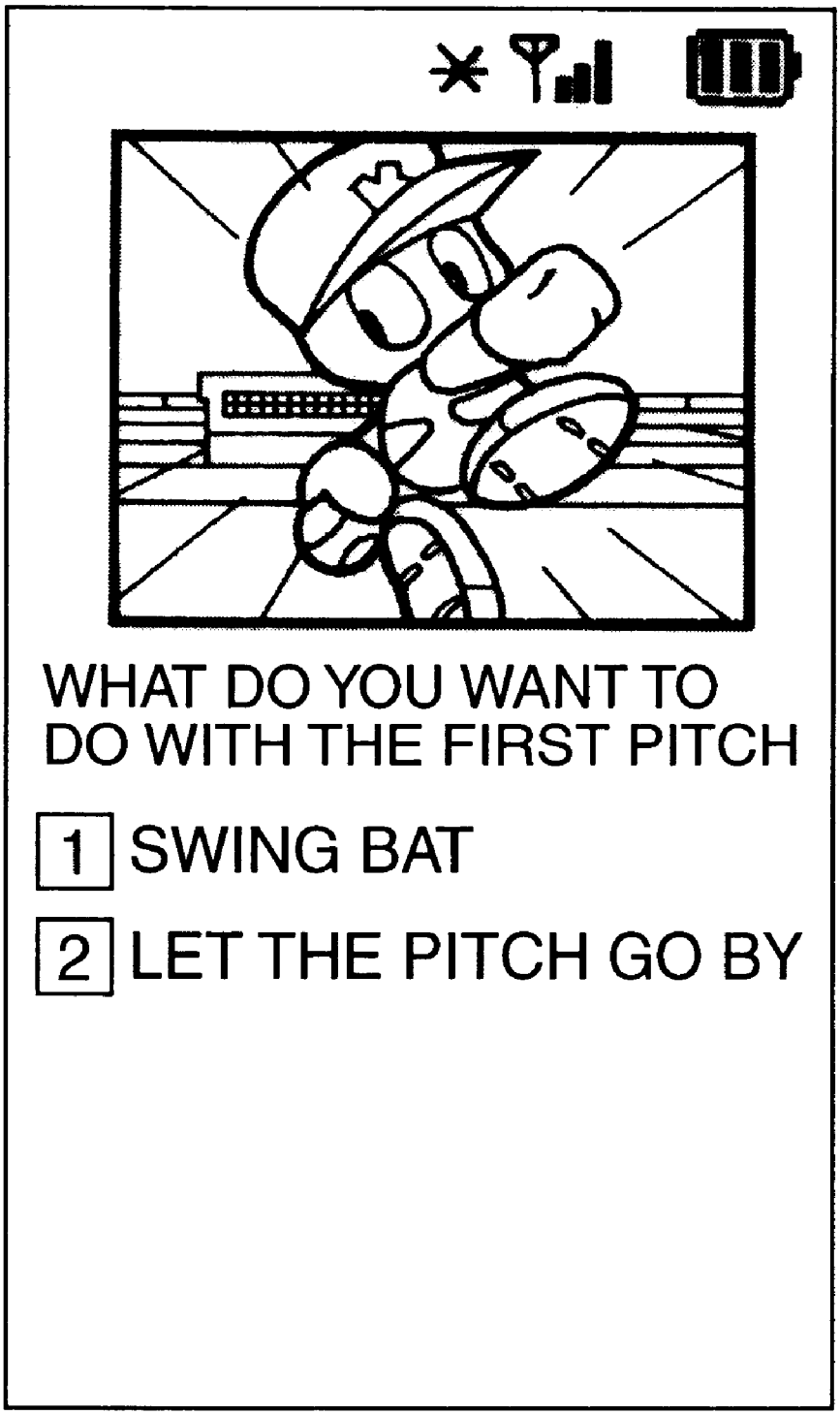
FIG. 18 shows one example of a monitor screen in a ease where "Test" (pitcher) has been selected.
Figure 19:
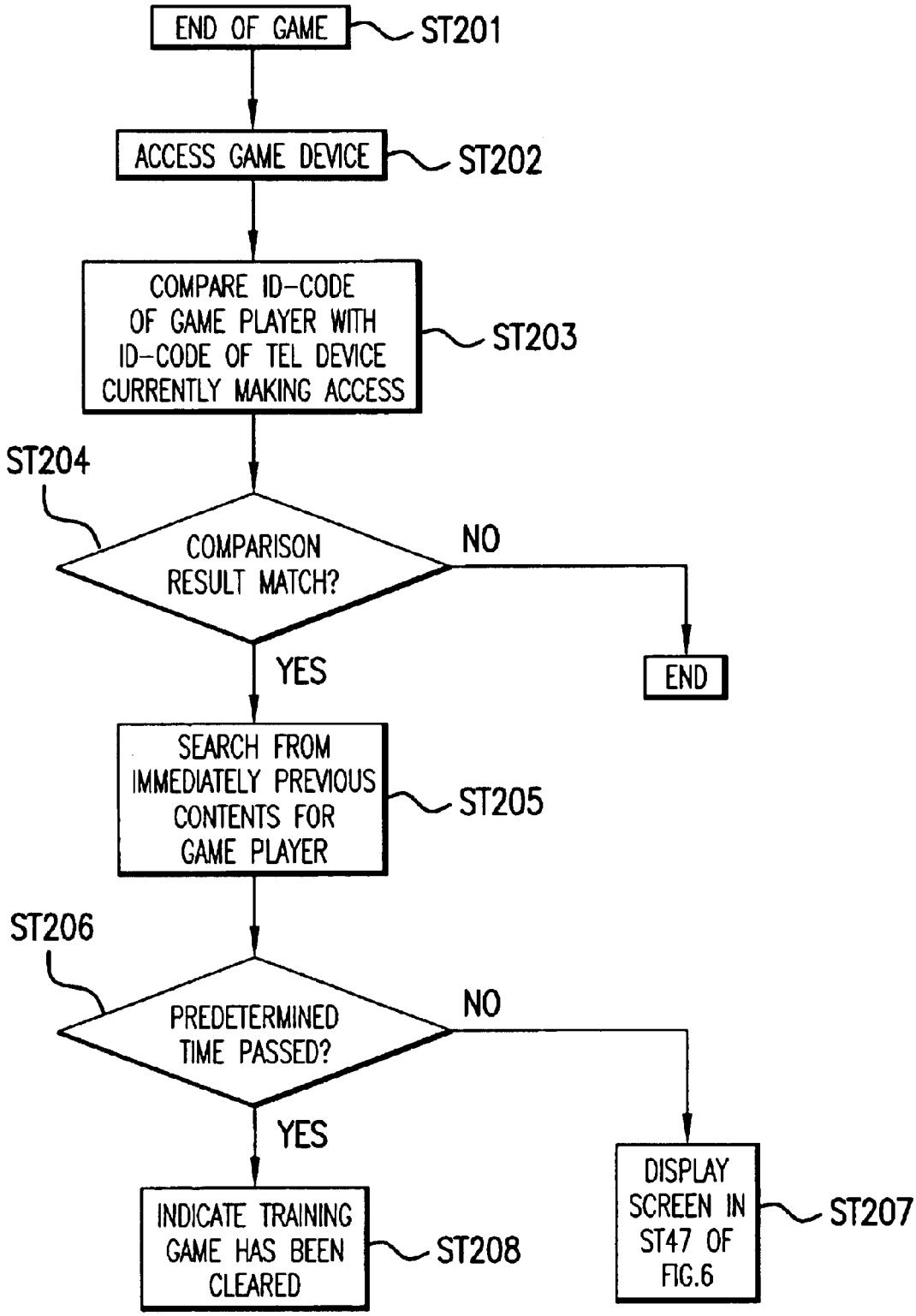
FIG. 19 is a diagram showing a flowchart illustrating a game procedure.
Figure 20:
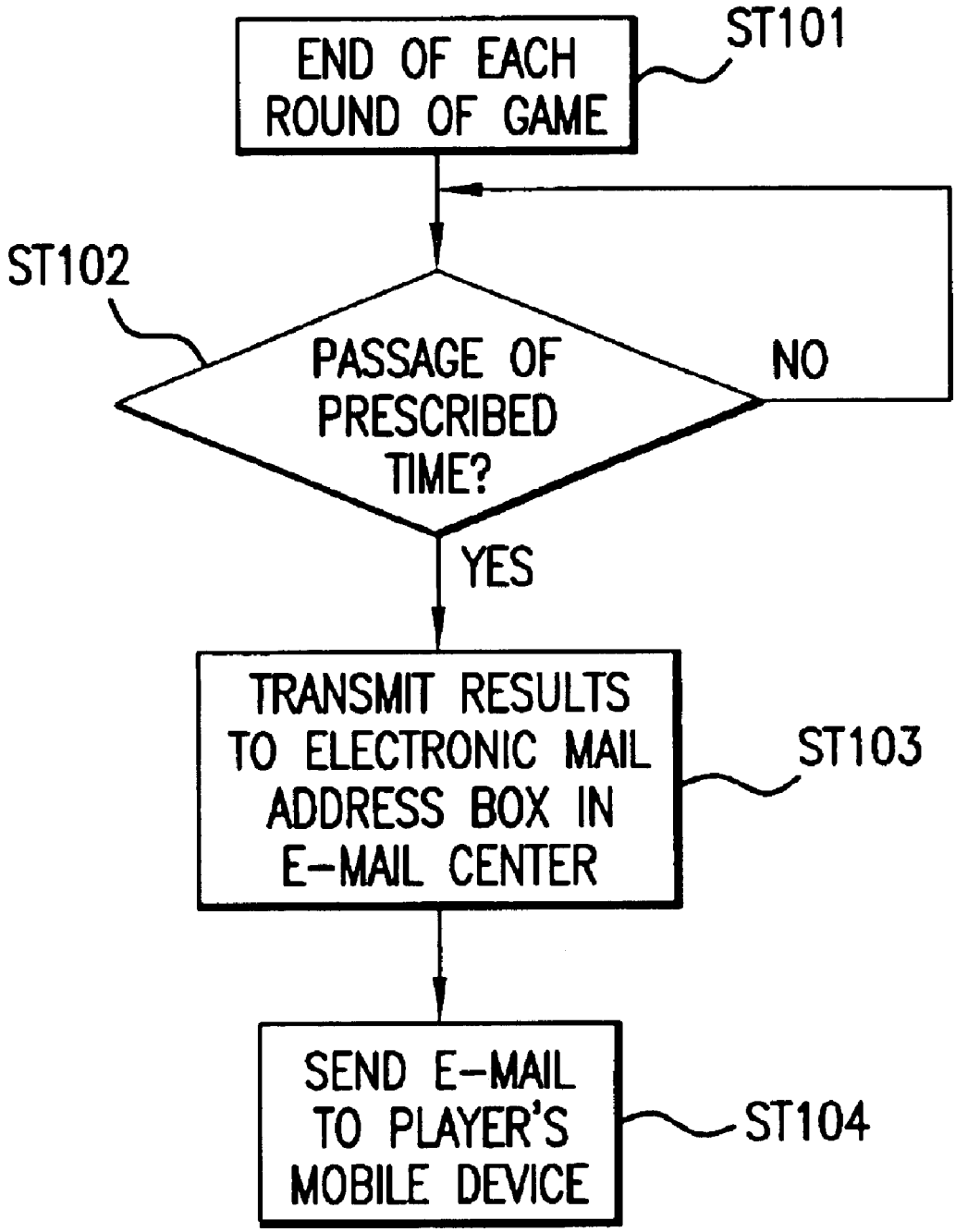
FIG. 20 is a diagram showing a flowchart illustrating a game procedure.

On the other hand, if a pitcher is selected at step ST9, then at step ST39, a test screen is displayed as illustrated in FIG. 18, comprising a two-choice screen consisting of the image of a pitcher in a pitching motion, the guide text "What do you want to do with the first ball?" and the options "1: Swing bat" and "2: Let the pitch go by", and as in the foregoing, step ST39–step ST45 are repeated until finally a hit is made or the batter is out, whereupon the procedure passes through steps ST47 and ST49 and then terminates.

From day 1 to day 45 in the game space timeframe, in other words, when the aforementioned game procedure is performed the first three times (each corresponding to 15 days), a clear result for each time is obtained, whereas from day 46 to day 60, in other words, the final time that the procedure is performed, an acquired points result and a training result represented by success or failure are obtained. In the first three rounds, it is judged whether the accumulated points acquired for each round have reached a set value forming a clear condition set for each round, and in the final round, it is judged whether or not the accumulated points acquired in the final round have reached a previously set training condition value.

If a training success is judged in the final round, then the game device 10 determines the training result type in the training result type data (password) memory 116. This is determined by taking account of the acquired values for the final round and the previous three rounds, making an association between the acquired points and each respective training result type, and deriving which training result type the result belongs to. Moreover, in the case of a training success, this may be determined randomly with no regard to the acquired values, or it may incorporate other conditions. For example, if prescribed practice menus are selected a conditional number of times or more, taking into account the selection contents on the various scenes of the game over 60 days of the game space timeframe, then a (previously determined) training result corresponding to same can be determined. In the present embodiment, a training result type is selected from 4 types of code data, or the like, representing type A to type D, and the corresponding code data, or the like, is transmitted.

On the other hand, if the clear condition value is not reached at the end of any one round, or if the training condition value is not reached at the final round, then a training failure is inferred at that time. Moreover, it also possible to devise processing whereby, even if the acquired value reaches a condition value, or the like, a training failure is inferred if, for example, "Play" has been selected a prescribed number of times or more, or if a prescribed options is selected in a particular round, or the like.

The passage of real time is monitored from the end of each round and the final round (ST101), and if, for example, four weeks has elapsed (ST102), then an acquired points result is transmitted to the electronic mail address box (ST103) input by the relevant mobile telephone device 20 and provided in the electronic mail (e-mail) center 31. Alternatively, if the electronic mail center 31 is provided with a function for sending transmitted acquired points results to the telephone number of the relevant mobile telephone device 20, then an e-mail is sent to the game-player's mobile telephone device 20 via the aforementioned center 31 (ST104).

In a mode where, in contrast to the aforementioned embodiment, the game-player does not wish to receive notification by e-mail, for example, then game results are notified as described below. Namely, alter the end of the game (ST201), the game-player accesses the game device 10 once again (ST202), and the game device 10 compares the ID code of the game-players mobile telephone device 20 as registered initially with the ID code of the telephone device currently making access (ST203). If the comparison result is a match ("Yes" in ST204), ten the device searches from the immediately previous contents for that game-player (ST205), determines whether or not, for example, four hours of real time have passed since to end of the immediately previous game (ST206), and if four hours have not passed ("No" in ST206), it displays the screen shown in step ST47 (ST207), to indicate that the acquired points results have not yet been obtained. If, on the other hand, four hours have passed ("Yes" in ST206), then it is indicated that the training game for the previous 15 days has been cleared (ST208).

Moreover, by means of the aforementioned time management, the game device 10 prohibits continuation of the previous game, unless four hours have passed.

The training result type data obtained in the foregoing manner is transferred to the domestic game device 40. In other words, once the aforementioned training result type data has been obtained, the game-player connects a cassette 44 storing the same baseball game program and starts up the domestic game device 40, which reads out the trained player character registration screen and displays same on the monitor 41, and the game-player inputs the aforementioned training result type data to this screen by means of the controller 43. Thereby, a player character trained by the mobile telephone device 20 can be incorporated into the original baseball game, and can be made to participate in the game as a player character. Code data, or the like, can be input from the game controller 43 by displaying a sequence of letters in a selectable fashion on the aforementioned input screen, and specifying the number or letters in the code data, one by one, from this letter sequence, by means of a cursor, or the like.

If a previous training game has been a success and code data, or the like, representing a training result type has been obtained, it is not desirable that the trained player character can be registered by anyone, simply by inputting the previously obtained code data, or the like, at a later time, without progressing through the game. Therefore, it should be set, for example, that only one player character of each type can be registered, multiple registration being prevented by means of a monitoring program provided in the domestic game device 40 monitoring whether or not the same type has already been input via the aforementioned input screen. Alternatively, it is also possible to adopt a composition where the contents of the clock means are incorporated in the training result type data, by encryption, or the like, and when this encrypted code data, or the like, is input to the domestic game device 40, a monitoring program of the domestic game device 40 extracts and checks the training game execution date and time, or the like, on the basis of prescribed rules (decryption rules similar to encryption rules), by using the built-in clock means, and if this execution date and time, or the like, is different, then the data is regarded as data obtained as a result of a game played using the mobile telephone device 20 and hence input and registration is permitted. By adopting this composition, since the previously obtained training result type data is encrypted, then even if the same data is entered, it is treated as data have no meaning, and hence it will not be accepted and multiple registrations can be avoided.

The present invention is also applicable to the following modes.

(a) The present invention can also be applied to games for training player characters other than baseball characters, and hence is able to provide a net game having good general applicability.

(b) In the present embodiment of the invention, if the domestic game device 40 is provided with an internal modem for transmitting data via a public circuit or network, then it is possible for the transmitted training result type data to be downloaded from the server 1 via the electronic mail (e-mail) center 31 to the domestic game device 40, or from the server 1 to the mobile telephone device 20. Furthermore, access for performing download is not limited to the server 1 and mobile telephone device 20, and can also be performed from the domestic game device 40. In this case, the burden on the game-player of performing input operations in order to obtain the training result type data is removed.

(c) In the present embodiment, a mobile transmission device, and in particular, a mobile telephone device 20, was described as a terminal device, but the present invention is not limited to this, and it also possible to use a personal computer having a communications modem for public telephone, Internet and e-mail networks (wired or wireless), or the like, and also provided with a monitor and key operating section. In the case of a personal computer, image information compressed by the JPEG format can be transmitted and received, and hence a very large volume of game data can be used and applicability to a variety of games is improved.

(d) The present embodiment was described with respect to a training game, but the present invention is not limited to a training game, and may also be applied, for example, to a fight-type game, time and points competition game, knowledge game, and various other types of game. The game result data transmitted to the game-player as a game result is not limited the training result type data described in the present embodiment (transmitted by electronic mail (e-mail) (or by Internet) to the game-player), but rather the game-player may be evaluated with respect to the game by means of points, performance results, or the like, in accordance with the type of game, or without regard to the type of game, and if the game result satisfies prescribed conditions, then, for example, a congratulatory image and coupon, or the like, may be issued to the game-player (which can be printed out by means of a printer or other such output device, and used as a valid certificate in an (affiliated) store, or the like, which is allied with the present network game system.)

Moreover, the present invention is also applicable to the following modes (1) to (14).

(1) A character training type game device forming a server for performing game processing on the basis of received data, composed in such a manner that it exchanges game data with a mobile communication device forming a terminal device having a monitor and an operating member, via a network, characterized in that it comprises: storing means (image memory 113–115) for storing character training game images including command requests, for a plurality of screens; first transmitting means (transmission and reception control section 112) for transmitting character training game images stored in said storing means to said mobile communication device, in single screen units; receiving means (transmission and reception control section 112) for receiving response data in response to said command requests; training processing means (training processing section 100, ROM 117) for executing character training game processing on the basis of the received response data; and second transmitting means (transmission and reception control section 112) for transmitting training result data obtained on the basis of said character training processing to said mobile communication device, at the least.

(2) A game character training method implemented by a character training game device forming a server for performing game processing on the basis of received data, composed in such a manner that it exchanges game data with a mobile communication device forming a terminal device having a monitor and an operating member, via a network, characterized in that it comprises the steps of: transmitting character training game images including command requests corresponding to a plurality of screens, as stored in storing means, to be displayed on the monitor of the aforementioned mobile communication device, one screen at a time; receiving response data in response to said command requests as obtained via operations performed to said operating member; executing character training game processing on the basis of received response data; and transmitting training result data obtained on the basis of said character training processing to said mobile communication device, at the least.

(3) A readable storage medium storing a game character training program for controlling a character training game device forming a server for performing game processing on the basis of received data, composed in such a manner that it exchanges game data with a mobile communication device forming a terminal device having a monitor and an operating member, via a network, characterized in that it causes implementation of the steps of: transmitting character training game images including command requests corresponding to a plurality of screens, as stored in storing means, to be displayed on the monitor of the aforementioned mobile communication device, one screen at a time; receiving response data in response to said command requests as obtained via operations performed to said operating member; executing character training game processing on the basis of received response data; and transmitting training result data obtained on the basis of said character training processing to said mobile communication device, at the least.

According to this composition, a game is executed by connecting, by means of a network, a mobile communication device forming a terminal device having a monitor and an operating member, and a character training game device forming a server for implementing game processing on the basis of received data and composed so as to perform transmission and reception of game data. In other words, when the mobile communication device has been accessed and a network communication has been established, the server transmits character training game images including command requests, one at a time, to the aforementioned mobile communication device to be displayed on the monitor thereof. At the mobile communication device side, the game-player observes the command requests on the monitor and operates the aforementioned operating member, thereby transmitting response data responding to the aforementioned command requests obtained by means of these operations, to the server side. At the server, character training game processing is executed on the basis of the received response data.

(4) In the mode of the invention in (1) above, said command requests may be requests for selection information for multiple-option type questions, whereby the operation on the mobile communication device side is simplified and a game can be implemented sufficiently on a mobile telephone device, or the like.

(5) In the mode of the invention in (1) and (4) above, the training processing means may be able to select character training game images to be transmitted, from the character training game images for a plurality of screens stored in the aforementioned storing means, in a random manner, whereby different screens appear in an arbitrary sequence each time the game is executed, and hence the game-player does not remember particular game buttons and does not become bored with the game.

(6) In the mode of the invention in (1), (4) and (5) above, type data storing means (training result type data memory 116) is provided for storing the aforementioned training result data as a variety of training result types, wherein the aforementioned training processing means extracts one training result type as training result data from the aforementioned type data storing means, on the basis of the character training processing, and since type data is used in this way instead of direct data for the trained ability values, or the like, subsequent processing (manual input to the domestic game device) can be performed readily by the game-player.

(7) In the mode of the invention in (1), (4)–(6) above, the aforementioned training result data is constituted by a code sequence of a prescribed digit number, and hence the training result data is in encoded form and can be readily confirmed.

(8) In the mode of the invention in (1), (4)–(7) above, the training processing means comprises: game development processing means (game development processing section 102) for executing player character training processing by repeating the operation of transmitting the aforementioned character training game images and receiving response data corresponding to same, a prescribed number of times, and judging means (success and failure judgment processing section 105) for judging training success or failure from the prescribed number of response data; wherein the aforementioned second transmitting means transmits said training result data to said mobile communication device, when a training success is judged; whereby the game is developed by repeating the operation of transmitting character training game images and receiving response data corresponding to same, a prescribed number of time, and hence the game can be executed without the game-player becoming bored. Moreover, since the training result data is transmitted, it is possible to discover the game result without performing special operations.

(9) In the mode of the invention in (8) above, the aforementioned game developing means successively accumulates a score, which may increase or decrease, as character training processing, and the aforementioned judging means determines a training success if the accumulated value is a prescribed value or above. Thereby, the judgment reference is clearly understood.

(10) In the mode of the invention in (8) above, the aforementioned training processing means comprise first clock means (clock section 107) for measuring days and hours, and evaluating means (evaluation processing means 104); and said game development processing means executes said prescribed number of times in a distributed manner of a plurality of days; said evaluating means evaluates a clear status during the game by receiving response data in the games executable on each day, apart from the final day; and said second transmitting means transmits the evaluation result of said clear status to said mobile communication device; whereby the game is executed over a plurality of days of real time, the clear status being evaluated and transmitted on each day, and hence, rather than providing a simple game, it is possible to provide a broad-ranging game which takes time, in a relatively straightforward manner.

(11) In the mode of the invention in (10) above, the aforementioned evaluating means may be configured so as to judge that the game has been cleared if the accumulated points acquired as of the day of evaluation are more than the clear condition value, whereby the evaluation can be more definite.

(12) In the mode of the invention in (1) to (11) above, the training processing means comprises second clock means (clock section 107) for counting days and hours; wherein the second transmitting means transmits at least the training result data of the training result data and the evaluation result to said mobile communication device after a prescribed period of time has elapsed from the time at which the game ends, on the basis of the time information from the second clock means. Thereby, the training result data, and the like, is transmitted after a prescribed period of time from the end of the game, and hence a waiting time is applied and hence a sense of expectation, and the like, can be generated.

(13) A character training game system may be a game system constituted by a server located on a network and performing game processing and transmission and reception of game data, and a mobile communication device forming a terminal device comprising a monitor (monitor 202) and operating member (key group 201) capable of exchanging game data with the server via the network, wherein the server comprises: storing means for storing character training game images including command requests, for a plurality of screens; first transmitting means for transmitting the character training game images stored in the storing means, one screen at a time, to the mobile communication device; receiving means for receiving response data corresponding to the command requests; training processing means for executing character training processing on the basis of received response data; and second transmitting means for transmitting training result data obtained on the basis of said character training processing to the mobile communication device, at the least; and said mobile communication device comprises: display control means (display control section 206) for causing data received from the server to be displayed on the monitor; first receiving means (transmission/reception control section 208) for receiving character training game images from the server and providing same to the display control means; transmitting means (transmission/reception control section 208) for transmitting response data obtained by performing operations to the operating member, to the server; and second receiving means (transmission/reception control section 208) for receiving training result data from the server and providing same to the display control means.

(14) A game character training game method may be a game method implemented between a server located on a network and performing game processing and transmission and reception of game data, and a mobile communication device forming a terminal device provided with a monitor and operating member and capable of exchanging game data with the aforementioned server via the network; wherein the server performs the steps of: storing character training game images including command requests, for a plurality of screens; transmitting the character training game images stored in the server, one screen at a time, to the mobile communication device; receiving response data corresponding to the command requests; executing character training processing on the basis of received response data; and transmitting training result data obtained on the basis of said character training processing to the mobile communication device, at the least; and said mobile communication device performs the steps of: receiving character game images from the server and displaying same on the monitor; transmitting response data obtained by performing operations to the operating member, to the server; and receiving training result data from the server and providing same to the monitor.

According to (13) and (14) above, a game system can be constituted by a mobile communication device and a server, by using a network, and a training game method can be implemented therein, and hence the game-player is able to play the present training game without having to carry about the game device.

Advantages of the Invention

According to the present invention, it is possible to play a game and to transmit the game result, without having to carry about the game device, and hence the game-player can be notified of the game result, and the like, without having to perform special operations, thereby providing a network game which is highly interesting.

Moreover, the present invention may also comprise: clock means, wherein the transmitting and receiving means performs transmission of the prescribed data after a prescribed period of time has elapsed after the end of a game. Thereby, the prescribed data obtained from said game results is transmitted after a prescribed period of time has elapsed from the end of the game, and hence a waiting time can be applied, and a sense of anticipation can be created in the game-player.

Moreover, the prescribed data may represents any one of the acquired points, game performance or special benefits corresponding to the game result, whereby an evaluation result for the game-player for the game, such as acquired points, performance, or the like, can be obtained (known), and if the game result satisfies prescribed conditions, then, for example, a congratulatory image and coupon, or the like, may be issued to the game-player (which can be printed out by means of a printer or other such output device, and used as a valid certificate in an (affiliated) store, or the like, which is allied with the present network game system), and moreover, if the game seeks to improve abilities corresponding to a prescribed character in the game, then the training result (ability) data for the trained character can be obtained in the form of a password consisting of prescribed code data, or the like.

Furthermore, the game data may be the data relating to the training of the game character, comprising training command request data transmitted by the server side game device, and response data from the terminal device in response to the command request data. Thereby, the network game is a game which aims to train a game character. In this mode, the server side game device transmits training command request data and conducts training game processing using response data transmitted by the terminal device in response to this command request data. Hence a training game can be performed from a device other than a domestic game device, and a network game having high general applicability is achieved.

Furthermore, the terminal device may be a mobile communication device, whereby the game can be played in any place and at any time, by means of a mobile telephone device, or the like, having excellent portability.

Moreover, the game data transmitted by the transmitting and receiving means may be constituted by image data and text data, and hence it is possible to enhance game characteristics and to improve applicability to a variety of games.

This application is based on Japanese application serial no. 2000-98955 filed in Japan on Mar. 31, 2000, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A network game device, which is a server side game device for performing game processing on the basis of received data, said network game device comprising:

transmitting and receiving means for transmitting and receiving game data, via a network, to and from an input device provided with a monitor and an operating member;

said transmitting and receiving means transmitting all entered data from the input device to the server without intended delay;

game development processing means for performing game processing in response to all entered input data during a game;

means for creating prescribed data corresponding to game results;

wherein said transmitting and receiving means transmits said created prescribed data to said input device, via the network; and clock means for monitoring passage of real time, wherein said transmitting and receiving means delays transmission of the prescribed data until a passage of a predetermined time period from a time of termination of access of the input device to the network after completion of the game and performs transmission via the network of the prescribed data in response to the passage of the predetermined time period.

2. The network game device according to claim 1, wherein said prescribed data represents one of the acquired points, game performance, and special benefits corresponding to the game result.

3. The network game device according to claim 1, wherein said game data is data relating to the training of a game character, and said game data includes training command request data transmitted by said server side game device and response data from said input device in response to said command request data.

4. The network game device according to claim 1, wherein said input device is a mobile communication device.

5. The network game device according to claim 1, wherein the game data transmitted by said transmitting and receiving means includes image data and text data.

6. The network game device according to claim 1, wherein said transmitting and receiving means including a first transmission means and a second transmission means and said network game device further comprising:

storing means for storing character training game images including command requests and said first transmission means transmits character training game images stored in said storing means to said input device;

receiving means for receiving response data from said input device in response to said command requests; and training processing means for executing character training program processing based on the received response data and wherein said second transmitting means transmits training result data obtained based on the character training processing to said input device.

7. The network game device according to claim 6, wherein said first transmitting means transmits the training game images stored in said storing means to said input device one at a time.

8. A network game method for a server side game device for performing game processing on the basis of received data, that is configured so as to transmit and receive game data, via a network, to and from an input device provided with a monitor and an operating member, said network game method comprising the steps of:

transmitting and receiving all entered data from the input device to the server without intended delay;

performing game processing in response to all entered input data during a game;

creating prescribed data corresponding to game results at the end of a game;

transmitting said created prescribed data to said input device, via the network; and monitoring passage of a real time so that said transmission of said created prescribed data to said input device is delayed until a passage of a predetermined time period from a time of a termination of access to the input device after completion of the game and transmission via the network of the created prescribed data is performed in response to the passage of the predetermined time period.

9. A readable storage medium storing a network game program for operating a server side game device for performing game processing on the basis of received data, that is configured so as to transmit and receive game data, via a network, to and from an input device provided with a monitor and an operating member; said network game program comprising the steps of:

transmitting and receiving all entered data from the input device to the server without intended delay;

performing game processing in response to all entered input data during a game;

creating prescribed data corresponding to game results at the end of a game; and transmitting said created prescribed data to said input device, via the network so that transmission of the created prescribed data is delayed until a passage of a predetermined time period from a time of termination of access of the input device to the network after completion of the game and transmission is performed via the network in response to the passage of the predetermined time period.

10. A network game system comprising a server side game device located on a network for performing game processing and transmission and reception of game data, and an input device for of transmitting and receiving game data to and from said server side game device via the network, comprising:

transmitting and receiving means for transmitting and receiving game data, via the network, to and from the input device;

said transmitting and receiving means transmitting all entered data from the input device to the server without intended delay;

said server side game device including:

game development processing means for performing game processing in response to all entered input data during a game;

means for creating prescribed data corresponding to game results; and means for transmitting said created prescribed data to said input device, via the network; and clock means for monitoring passage of a real time, wherein said transmitting means delays transmission of the prescribed data until a passage of a predetermined time period from a time of termination of access of the input device to the network after completion of the game and performs transmission via the network of the prescribed data in response to passage of the predetermined time period; and said input device including:

a monitor;

an operating member;

means for creating response data by operating said operating member in response to game data received from said server side game device and transmitting said response data to said server side game device; and means for receiving said prescribed data from said server side game device.

11. The network game system according to claim 10, wherein said prescribed data represents one of the acquired points, game performance, and special benefits corresponding to the game result.

12. The network game system according to claim 10, wherein said game data is data relating to the training of the game character, and said game data includes training command request data transmitted by said server side game device and response data from said input device in response to said command request data.

13. The network game system according to claim 10, wherein said input device is a mobile communication device.

14. The network game system according to claim 10, wherein the game data transmitted by said transmitting means includes image data and text data.

15. The network game system according to claim 10, wherein said transmitting means including a first transmission means and a second transmission means and said network game device further comprising:

storing means for storing character training game images including command requests and said first transmission means transmits character training game images stored in said storing means to said input device;

receiving means for receiving response data from said input device in response to said command requests; and training processing means for executing character training program processing based on the received response data and wherein said second transmitting means transmits training result data obtained based on the character training processing to said input device.

16. The network game system according to claim 15, wherein said first transmitting means transmits the training game images stored in said storing means to said input device one at a time.

17. A network game device, which is a server side game device for performing game processing on the basis of received data, said network game device comprising:

a processing section including:

a game day number managing section for performing processing one day of a time frame in a game space that is different from one day in real time;

a clock section for counting a real time and monitoring that a game for one round consisting of a plurality of days in the game space time is not executed within one day of the real time, and said clock section monitoring that a predetermined time period in the real time has passed after a completion of each one of the rounds and prohibiting a continuation of a game play from the previous round unless the predetermined time period in the real time has passed;

transmitting and receiving means for transmitting and receiving game data, via a network, to and from an input device provided with a monitor and an operating member;

said transmitting and receiving means transmitting all entered data from the input device to the server without intended delay;

game development processing means for performing game processing in response to all entered input data during a game;

means for creating prescribed data corresponding to game results; wherein said transmitting and receiving means transmits said created prescribed data to said input device, via the network after completion of the game; and wherein said transmitting and receiving means performs transmission of the prescribed data only after passage of a predetermined constant time period monitored by said clock section from the time of completion of termination of access by the input device to the network after each one of the rounds.

18. The network game device according to claim 17, wherein said prescribed data represents one of the acquired points, game performance, and special benefits corresponding to the game result.

19. The network game device according to claim 17, wherein said game data is data relating to the training of the game character, and said game data includes training command request data transmitted by said server side game device and response data from said input device in response to said command request data.

20. The network game device according to claim 17, wherein said input device is a mobile communication device.

21. The network game device according to claim 17, wherein the game data transmitted by said transmitting and receiving means includes image data and text data.

22. The network game device according to claim 17, wherein said transmitting and receiving means including a first transmission means and a second transmission means and said network game device further comprising:

storing means for storing character training game images including command requests and said first transmission means transmits character training game images stored in said storing means to said input device;

receiving means for receiving response data from said input device in response to said command requests; and training processing means for executing character training program processing based on the received response data and wherein said second transmitting means transmits training result data obtained based on the character training processing to said input device.

23. The network game device according to claim 22, wherein said first transmitting means transmits the training game images stored in said storing means to said input device one at a time.

24. A network game device, which is a server side game device for performing game processing on the basis of received data, said network game device comprising:

transmitting and receiving means for transmitting and receiving game data, via a network, to and from an input device provided with a monitor and an operating member;

said transmitting and receiving means transmitting all entered data from the input device to the server without intended delay;

game development processing means for performing game processing in response to all entered input data during a game;

means for creating prescribed data corresponding to game results;

wherein said transmitting and receiving means transmits said created prescribed data to said input device, via the network; and clock means for monitoring passage of real time, wherein said transmitting and receiving means performs transmission of the prescribed data after passage of a predetermined time period from a time of a termination of access of the input device to the server side game device after completion of the game.

25. The network game device according to claim 24, wherein said prescribed data represents one of the acquired points, game performance, and special benefits corresponding to the game result.

26. The network game device according to claim 24, wherein said game data is data relating to the training of the game character, and said game data includes training command request data transmitted by said server side game device and response data from said input device in response to said command request data.

27. The network game device according to claim 24, wherein said input device is a mobile communication device.

28. The network game device according to claim 24, wherein the game data transmitted by said transmitting and receiving means includes image data and text data.

29. The network game device according to claim 24, wherein said transmitting and receiving means including a first transmission means and a second transmission means and said network game device further comprising:

storing means for storing character training game images including command requests and said first transmission means transmits character training game images stored in said storing means to said input device;

receiving means for receiving response data from said input device in response to said command requests; and training processing means for executing character training program processing based on the received response data and wherein said second transmitting means transmits training result data obtained based on the character training processing to said input device.

30. The network game device according to claim 29, wherein said first transmitting means transmits the training game images stored in said storing means to said input device one at a time.

31. A network game device, which is a server side game device for performing game processing on the basis of received data, said network game device comprising:

transmitting and receiving means for transmitting and receiving game data, via a network, to and from an input device provided with a monitor and an operating member;

said transmitting and receiving means transmitting all entered data from the input device to the server without intended delay;

game development processing means for performing game processing in response to all entered input data during a game such that the network game is a non-turn based game;

means for creating prescribed data corresponding to game results;

wherein said transmitting and receiving means transmits said created prescribed data to said input device, via the network; and clock means for monitoring passage of real time, wherein said transmitting and receiving means delays transmission of the prescribed data until a passage of a predetermined time period from a time of termination of access of the input device to the network after completion of the game and performs transmission via the network of the prescribed data in response to the passage of the predetermined time period.

* * * * *